US006731886B2

(12) United States Patent
Takeda

(10) Patent No.: US 6,731,886 B2
(45) Date of Patent: May 4, 2004

(54) SURFACE DISCRIMINATING DEVICE AND IMAGE FORMING APPARATUS HAVING THE SAME

(75) Inventor: Masami Takeda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/146,797

(22) Filed: May 17, 2002

(65) Prior Publication Data

US 2002/0181963 A1 Dec. 5, 2002

(30) Foreign Application Priority Data

May 18, 2001 (JP) ..... 2001/148715

(51) Int. Cl.[7] ..... G03G 15/00
(52) U.S. Cl. ..... 399/45; 73/105; 73/661
(58) Field of Search ..... 399/45, 69, 38; 73/1.89, 105, 649, 658, 661

(56) References Cited

U.S. PATENT DOCUMENTS 5,546,374 A * 8/1996 Kuroda et al. ..... 369/126
2002/0178799 A1 * 12/2002 Kitazawa et al. ..... 73/105

FOREIGN PATENT DOCUMENTS

| | | |
|---|---|---|
| JP | 04-315162 | * 11/1992 |
| JP | 04-358189 | * 12/1992 |
| JP | 2000-314618 | 11/2000 |
| JP | 2000-356507 | 12/2000 |

* cited by examiner

*Primary Examiner*—Sophia S. Chen
(74) *Attorney, Agent, or Firm*—Fitzpatrick, Cella, Harper & Scinto

(57) ABSTRACT

A surface discriminating device for a recording material includes a probe having a fixed first end portion and a second end portion capable of contacting with the recording material, the probe being adapted to contact with and move relative to the recording material to thereby scan the recording material, and a piezoelectric element provided between the first end portion and the second end portion of the probe. The surface of the recording material is discriminated by the output from the piezoelectric element during the scanning of the recording material by the probe, the probe having a bent portion on the second end portion side.

30 Claims, 21 Drawing Sheets

SURFACE DISCRIMINATING DEVICE AND IMAGE FORMING APPARATUS HAVING THE SAME

BACKGROUND OF THE INVENTION

1. Field of the Invention

The invention relates to an image forming apparatus such as a printer, a copying machine, an ink jet printer, a thermal head printer, a dot impact printer, or a facsimile apparatus of the electrophotographic type or a compound apparatus of these, and particularly to a surface, surface roughness, surface smoothness, or surfaceness discriminating device for discriminating the surfaces of recording materials applicable to these.

2. Description of Related Art

Various kinds of image forming apparatuses heretofore known are generally apparatuses for forming an image on a sheet-like recording material such as plain paper, a postcard, cardboard, an envelope or a plastic thin sheet for OHP, and in an apparatus such as a printer, a copying machine or a facsimile apparatus using the electrophotographic process as a typical example thereof, a toner is used as a developer and a toner image is formed on the recording material by electrostatic image forming means, whereafter the recording material is heated and pressurized by fixing means to thereby fusion-bond the toner image on the recording material and accomplish image formation.

Also, apparatuses such as a printer, a copying machine and a facsimile apparatus using the ink jet process which are other apparatuses use ink as a developer, and form an image on a recording material by image forming means for discharging the ink at a high speed from a recording head constructed by the use of a number of nozzles having minute orifices by the utilization of mechanical or thermal reaction.

Apparatuses such as a printer, a copying machine and a facsimile apparatus using the heat transfer process use an ink ribbon as a developer, and form an image on a recording material by image forming means for thermally transferring ink from the ink ribbon by the use of a thermal head.

By the way, these apparatuses have been improved in recent years and contrivances for a higher quality of image and a higher processing speed have come to be realized by various means and at the same time, a measure for reduced costs has also been contrived and lower prices have been advanced and the apparatuses have come to spread widely.

However, the kinds of recording materials used in these image forming apparatuses are various from plain paper to high-class paper subjected to special surface treatment for use as an envelope and a resin sheet for OHP. Further, these recording materials have come to be used all over the world with the spread of the apparatuses and therefore, it has become necessary to cope with any recording materials used in various parts of the world so as to be capable of forming good images, and particularly the roughness of the surfaces of recording materials with greatly affects the image forming conditions is a very important factor.

For example, in an apparatus adopting the electrophotographic process, when the surface of the recording material used is smooth (hereinafter referred to as smooth paper) and when the surface of the recording material used is rough (hereinafter referred to as rough paper), the heating efficiency of transmitting heat from a heat source to the paper surface in a fixing portion differs in accordance with the heat resistance difference due to the difference in surface roughness, and if the rough paper is fixed at a fixing temperature proper for the smooth paper, insufficient fixing will result and therefore, for the rough paper, it is necessary to fix at a higher temperature. Thus, in the apparatuses as they are, the temperature which can fix the rough paper is used as the fixing temperature and the smooth paper remains fixed always at an excessive temperature and further, for rougher paper, a still higher fixing temperature is necessary and therefore, when such paper is used, there has been provided a selecting mode for making a user change the setting of the fixing temperature.

As a specific example of these, the basic construction of a printer adopting the electrophotographic process is shown in FIG. 3A of the accompanying drawings.

FIG. 3A is a cross-sectional view of the essential portions of a conventional printer, and in the printer, the surface of a photosensitive drum 102 is uniformly charged to a predetermined polarity by a charging roller 101, whereafter charges are eliminated from only that area of the photosensitive drum 102 which has been exposed by exposing means 103 such as a laser to thereby form a latent image on the photosensitive drum 102. The latent image is developed and visualized as toner image by the use of a toner 105 in a developing device 104. That is, the toner 105 in the developing device 104 is triboelectrically charged to the same polarity as the charged surface of the photosensitive drum 102 between a developing blade 104*a* and a developing sleeve 104*b*, and a DC bias and an AC bias are superimposed and applied in a developing gap portion wherein the photosensitive drum 102 and the developing sleeve 104*b* are opposed to each other, and the toner 105 is caused to selectively adhere to the latent image forming portion of the photosensitive drum 102 while being floated and vibrated by the action of an electric field, whereafter the toner 105 is carried to a transfer nip portion formed between a transferring roller 110 and the photosensitive drum 102 by the rotation of the photosensitive drum 102.

On the other hand, a recording material 107 such as paper on which an image is to be recorded has its leading edge portion fed from a recording material containing box 107' to a pair of vertically conveying rollers 106' by a pair of feed rollers 107", and thereafter it is conveyed to a pair of ante-transfer conveying rollers 106 by the pair of vertically conveying rollers 106', and is further conveyed to the transfer nip portion along a transfer guide plate 109 at a prescribed angle of entry by the ante-transfer conveying rollers 106. During the time when the recording material 107 is conveying from the ante-transfer conveying rollers 106 to the transfer nip portion, the surface of the recording material 107 may be charged by the frictional contact thereof with various members with which the recording material 107 contacts until it is conveyed to this area and therefore, a charge eliminating brush 108 for eliminating such unnecessary charges which may become a factor disturbing the image when electrostatic recording is effected is provided so as to contact with the back side of the recording material 107 being conveyed, and is grounded.

In order to electrostatically attract the toner 105 on the photosensitive drum 102 to the recording material 107 side in a transferring portion, a high voltage opposite in polarity to the toner 105 is applied to a transferring roller 110 on the back of the recording material 107, whereby the toner 105 is electrostatically attracted to the back of the recording material 107 and the toner image is transferred to the recording material 107 and also, the back side of the recording material 107 is charged to a polarity opposite to that of the toner 105, and transferring charges for continuing to hold the transferred toner 105 are imparted to the back side of the recording material 107.

Lastly, the recording material 107 to which the toner image has been transferred is conveyed to a fixing device 112 comprised of a heating rotary member 113 and a pressure roller 114 forming a nip portion therewith, and is heated and pressurized while being controlled to a constant temperature by constant temperature control means 116 provided on the heating rotary member 113 side so as to maintain a fixing temperature preset in the nip portion, whereby the toner image is fixed.

Adhering substances such as the toner differing in polarity remain slightly on the surface of the photosensitive drum 102 after the toner image has been transferred therefrom and therefore, the adhering substances on the surface of the photosensitive drum 102 after it has passed the transfer nip portion are scraped off by a cleaning blade 111*a* on a cleaning container 111 counter-abutting against the surface of the photosensitive drum 102, whereafter the photosensitive drum 102 stands by in preparation for the next image formation.

In the above-described steps, a fixing device of the contact heat type good in the heat efficiency and safety is widely known as an image fixing process, and use has heretofore been made chiefly of a heat roller fixing device comprised of a heat fixing roller comprising a metallic cylinder mandrel having a mold-releasable layer formed on the surface thereof, and containing a halogen heater in the cylinder, and a pressure roller comprising a metallic mandrel having an elastic layer of heat-resistant rubber formed thereon, and having a pressure side mold-releasable layer formed on the surface thereof, the pressure roller being brought into pressure contact with the heat fixing roller, but in recent years, as a type still higher in heating efficiency, use has come to be made of a film heating type fixing device as shown in FIG. 3B of the accompanying drawings which comprises a fixing film unit 113' comprised of fixing film 113' comprising heat-resistant resin film 113*c'* of low heat capacity having an electrically conductive primer layer 113*b'* formed thereon, and further having a mold-releasable layer 113*a'* formed on the surface thereof, a ceramic heater 115 inside it and a heater holder 113*d'* serving also as a film guide member, and a metallic stay 113*e'* for uniformly pressurizing, and a pressure roller 114 comprising a pressure mandrel 114*c* having a silicon rubber layer 114*b* and a PFA tube layer 114*a* formed thereon, the pressure roller 114 being brought into pressure contact with the fixing film unit 113'.

In the ceramic heater 115 of the above-described film heating type fixing device, as shown in the cross-sectional view of FIG. 3C of the accompanying drawings, electrically energized heat generating members 115*b* comprising band-like patterns formed of a material such as silver palladium (Ag/Pd), $RuO_2$ or $Ta_2N$ are formed in two rows on one surface of a ceramic substrate 115*a* formed of alumina or the like, and the surface thereof is covered with protective glass 115*c*, and a thermistor 115*d* as temperature detecting means is formed on the surface thereof opposite to the heat generating member forming surface.

The film heating type fixing device of this kind, from the recent viewpoint of energy-saving promotion, has drawn attention as a type high in heat transfer efficiency and quick in the rising temperature speed of the apparatus as compared with a conventional heat roller type using as a fixing roller a cylindrical metal containing a halogen heater therein, and has come to be applied also to machines of a higher speed, and particularly in this type, importance is attached to the temperature rising speed and therefore, it is necessary to make the heat capacity of the heating surface of a fixing portion small and as a result, it is difficult to form an elastic layer on the heating surface, and a hard heating surface is used. Thus, the fixing process of this kind is liable to cause a difference in the heating efficiency due to the concavo-convexity difference of the surface of the recording material.

In various image forming apparatuses such as printers using such a fixing device, with the higher processing speed as previously described, there arises the problem that the difference in fixing property becomes remarkable due to the difference in the kind of paper, and it is necessary for the user himself to input a proper fixing mode to the printer in advance in conformity with the kind of paper the user is about to use. FIG. 4 of the accompanying drawings is a flowchart showing the fixing step in the image forming process of a conventional apparatus, and here is shown an example in which two ways of selection of ordinary smooth paper and rough paper having a rough surface are made possible simply as the setting of the kinds of paper.

In the flowchart shown in FIG. 4, when rough paper is selected, fixing is effected with the temperature made higher by $\alpha$ relative to the fixing temperature T for ordinary paper, and the rough paper is full-power-heated at the rated power upper limit value of the heater from a point after a printing signal has been received until the fixing temperature of each mode is reached, and after a target value is reached, constant temperature control is effected until the fixing of the last paper is ended so that the heater temperature lowering in conformity with the quantity of heat taken away with the supply of paper may be maintained constant to thereby maintain the fixing temperature.

The flow of the fixing step by such a flowchart is basically the same in both of a heat roller fixing device and a film heating type fixing device, but in the latter, the temperature of the back side of a heater substrate is detected and temperature control is effected and therefore, the heating action of members, such as the pressure roller, other than the heater increases the heat accumulating effect of the entire fixing device resulting from the continuous supply of paper, and there occurs a case where the actual temperature of the fixing nip portion becomes higher than the controlled temperature of the heater (accordingly, strictly, it is not appropriate to call the controlled temperature in the fixing device of this type the fixing temperature, and hereinafter this controlled temperature will be referred to as the attempered temperature). Therefore, as a countermeasure for preventing drawbacks such as the hot offset by excessive heating (the phenomenon that the toner is too much fused and is partly residual on the fixing film side and thereafter, readheres to inappropriate locations on the paper), the backward scattering of the toner and bad paper conveyance resulting from the production of a great deal of water vapor, it is necessary to stepwisely lower the heating temperature of the heater at a predetermined rate in accordance with the number of supplied sheets, and at this time, the fixing start temperature for the rough paper is made higher than the fixing start temperature for the ordinary paper and also, the number of supplied sheets for which the temperature is to be lowered is set at a proper value individually found in conformity with the characteristic of each sheet of paper.

FIG. 5 of the accompanying drawings is a graph showing changes in the attempered temperature for each sheet and each number of supplied sheets in a conventional image forming apparatus designed to stepwisely lower the attempered temperature as described above, and by following such setting, there is realized a film heating type fixing device having a fixing speed of sixteen (16) sheets per minute.

However, compelling the user to select a mode in order to change over the fixing condition for each kind of paper used in the manner described above has caused an increase in the user's burden of work and also has led to the possibility that when a wrong mode is selected, the fixing property for the sheets to be printed therein becomes deficient or conversely excessive heating is effected to thereby waste electric power and bad images due to high temperature offset occur and the contamination of the fixing device by the toner results.

Also, as in recent years, in an environment of use wherein a plurality of users share a network printer, it may be possible that a user uses special paper and effects mode setting changeover conforming thereto, whereafter the special paper is left in the apparatus and therefore, when another user who does not know it uses the apparatus, the mode does not coincide and appropriate fixing fails to be done, and this also leads to the high possibility of the above-noted problem arising.

Also, regarding the number of settable fixing modes, strictly there are various levels of the smoothness of actual paper and it is impossible to provide an optimum condition for each of them and therefore, sheets of paper having a certain range of smoothness are fixed together in the same mode to thereby limit the number of set modes, and there is a case where for particular paper, fixing is effected by the use of more than necessary electric power, and depending on the combination of paper and setting, there is also a case where inefficient fixing is effected.

On the other hand, in the aforedescribed apparatus adopting the ink jet process, the necessary amount of ink differs between a case where the recording material used is smooth paper and a case where the recording material used is rough paper, and even if an image is formed on rough paper with an amount of ink proper for smooth paper, the ink will permeate into the paper in the direction of thickness thereof to thereby cause the deficiency of density and therefore, for the rough paper, it is necessary to discharge more ink. Therefore, in the apparatus as it is, the amount of ink discharge for the rough paper has been used as the standard amount of discharge and for the smooth paper, images have remained formed always with excessive ink.

Also, in the apparatus adopting the thermal transferring process, the necessary amount of electric power differs between a case where the recording material used is smooth paper and a case where the recording material used is rough paper, and even if an image is thermally transferred onto the rough paper with an amount of electric power proper for the smooth paper, heat resistance is great and therefore the transferability of ink has been lowered to thereby cause the deficiency of density.

As described above, in any of the apparatuses as they are, excess temperature, ink or electric power is consumed to prevent the deterioration of the quality of image by the surface roughness of the recording material, and to prevent this, it is necessary to change over these conditions in conformity with the surface roughness of the recording material, but heretofore only such a method as compels the user to take the trouble to change the setting has been conceived.

So, in recent years, there have been made several propositions of apparatuses in which the surface roughness of a recording material is detected and image forming conditions are changed in conformity with the result of the detection to thereby effect image formation, and among them, apparatuses shown in Japanese Patent Application Laid-Open No. 2000-314618 and Japanese Patent Application Laid-Open No. 2000-356507 are mentioned as what propose the detecting principle of detecting means for the surface roughness of the recording material.

In these propositions, there is disclosed a method of detecting a physical phenomenon such as vibration or frictional sound caused by the frictional contact of contacting means for contacting with the surface of the recording material with the surface of the recording material, and detecting the difference in the amount of detection thereof as a difference in the surface roughness, and as a specific construction therefore, there is proposed a construction in which a piezoelectric element is provided on the contacting means to thereby convert vibration into an electrical signal and detect it.

In the above-described propositions, however, a specific constructional condition necessary for a member (hereinafter referred to as a probe) to be actually brought into contact with the surface of the recording material is not disclosed in detail, but there is only shown a construction in which a simple straight probe has one end thereof fixed on the downstream side in the scanning direction and has its upstream side distal end made to obliquely abut so as not to oppose the direction of movement of the recording material, and it is difficult to actually realize highly accurate detection from such content alone.

That is, as regards the difference in surface roughness between smooth paper and rough paper actually used as recording materials, when measured by a surface roughness meter usually used as a measuring device, the concavo-convexity difference of the surface of paper heretofore recognized as smooth paper is within a range of 15–20 $\mu$m at maximum, and the concavo-convexity difference of the surface of paper heretofore recognized as rough paper is within a range of 22–40 $\mu$m at maximum, and generally between the two, there is only a difference of about 15 $\mu$m, and the difference between smooth paper approximate to rough paper and rough paper approximate to smooth paper is only of the order of several $\mu$m. For the straight probe to obliquely abut against the surface of a recording material being conveyed and read such a minute concavo-convexity difference, there would occur to mind such limitations as the necessity of a very sharp needle-like shape for the tip end of the probe so as to be capable of following the concavo-convexity of several $\mu$m, the necessity of wear resistance capable of withstanding the frictional contact with tens of thousands of sheets of recording material till the end of the life of the apparatus and such a degree of rigidity that the probe will not be readily deformed even if deformed paper is supplied during the occurrence of jam, the necessity of such a degree of strong abutting pressure that the tip end of the probe will not leap up even if it frictionally contacts with the recording material at the conveying speed thereof, and the necessity of such a range of light abutting pressure as can follow without flattening the concavo-convexity of the soft surface of the recording material, and it is very difficult to make these contradictory conditions compatible, and from the viewpoints of at least durability and reliability, a needle-like probe virtually cannot be used and it is unavoidable to realize highly accurate detection by a probe which is high in rigidity to some extent. For this reason, a thin-plate-like probe higher in rigidity and hard to damage the surface of the recording material is conceived as a practically usable probe, and there would occur to mind a method of scanning the surface of the recording material not by a point, but by a side having a finite length, and discriminating the kind of the recording material by the intensity difference of vibration attributable to the surface roughness averaged by this scanning width, and a construction of this kind is shown in Japanese Patent Application Laid-Open No. 2000-356507.

FIGS. 6A and 6B of the accompanying drawings show the construction of a surface roughness sensor using the thin-plate-like probe, and FIGS. 7A and 7B show the result of having actually scanned the surfaces of a plurality of recording materials differing in surface roughness by the use of the surface roughness sensor using the thin-plate-like probe.

FIG. 6A is a top plan view of the surface roughness sensor, and FIG. 6B is a cross-sectional view of the surface roughness sensor as it is seen from a side thereof in the scanning direction, and as the probe, use is made of a linear type cross section probe 117 having a T-shape when it is seen from its top surface and having a straight cross-sectional shape.

The straight type cross section probe 117 is comprised of a T-shaped metal plate 118 of a thickness 0.15 mm made of SUS and a piezoelectric element 119 adhesively secured thereonto, each of a piezoelectric element side electrode 119' and a metal plate side electrode 118' soldered, the T-shaped longer side portion being fixed onto a rotary support shaft 120, the distal end 117' of a width 5 mm of the shorter side portion abutting against the surface of the upstream side of the recording material on the downstream side in the direction of movement of the recording material at an oblique angle of 30°, and a coil winding spring (not shown) provided on the rotary support shaft 120 so that a pressure force of 3 g–10 g can be applied to the distal end portion of the sensor with the frame of the apparatus as a fixed end.

The straight type cross section probe 117 produces distortion therein by vertical vibration created in the distal end of the metal plate by the frictional contact thereof with the paper (which strictly may be considered to be reciprocal vibration along an arcuate locus described by the distal end portion of the sensor, and if the paper conveying property is ignored and the sensor is made to abut against the scanning surface while being approximated to perpendicularity thereto, the horizontal component during vibration can be increased, but in this conventional construction, the position at which the distal end portion of the sensor can completely contact with the paper is only the initial abutting position, and after the distal end portion of the sensor frictionally contacts with the paper at that position and is jumped up, the extraneous force of a horizontal component resulting from paper conveyance become difficult to act and therefore, the vibration component in the scanning direction does not much increase even if the paper conveying property is sacrificed, and basically the vibration component in the vertical direction attributable to the concavo-convexity of the surface of the paper may be considered to be dominant) and the signal of the piezoelectric element made electromotive thereby is amplified to forty (40) times by an amplifying circuit (not shown) and is introduced into a measuring device at a period of two (2) msec. (a sampling speed which can be processed by an ordinary printer) (however, in the above-described construction, a construction using a rotary support shaft to pressurize and fix the sensor is not described in the aforedescribed example of the conventional art, but only a construction for simply fixing an anti-abutting side end portion is shown, but if the anti-abutting side end portion is completely fixed when paper is actually conveyed, there will be the possibility that it may hinder the conveyance of paper or injure the surface of the paper as long as the pressure is not set to very light pressure, and if on the other hand, the abutting pressure is too low, there will arise the problem that the paper will not be sufficiently frictionally contacted, and the contacting property of the sensor is also changed by the thickness of paper being conveyed and therefore, for the convenience of the accuracy of experiment, use is made of a rotary support shaft fixing method which is one of the constructions of the present invention).

The recording materials evaluated at this time are rough paper and smooth paper having a difference in smoothness therebetween as shown in FIG. 7A of the accompanying drawings (the letter "A" indicates rough paper of the bond origin, "B" indicates smooth paper normally used, and "C" indicates high-class rough paper having its surface decorated with wavy convex portions, and each number indicates the basis weight of each kind of paper), and when these recording materials were continuously conveyed at a speed of 141 mm/sec. in the named order and the sensor was made to scan them, the signal level was too low at weight of 3 g and therefore, the recording materials were pressurized with weight of 10 g, and the result thereof is shown in the graph of FIG. 7B of the accompanying drawings.

The smoothness is the number of seconds measured by a particular test apparatus for which a predetermined amount of air passes through the concavo-convexity of the surface of a sample piece. Accordingly, the less is the concavo-convexity of the surface, the smaller becomes the numerical value.

It is considered that for the paper of FIG. 7A higher in smoothness, the more difficult it is for vibration to be created in the sensor, and for the rough paper lower in smoothness, the more liable to occur is vibration in conformity with the concavo-convexity thereof and therefore, the height of the signal intensity in the graph of FIG. 7B should be in a relation converse to the height of the smoothness in FIG. 7A.

However, as can be seen from the graph of FIG. 7B, the sensor signal tends to become somewhat low for B75 or B105 which is paper particularly high in smoothness, but generally there is no signal intensity difference between smooth paper and rough paper or the relation between the two is reversed, and even if as previously described, the contact property between the sensor and the paper is improved by the use of the rotary support shaft fixing method of the present invention, it has been difficult to detect the sufficient difference in the smoothness of the paper by the sensor of such construction to thereby discriminate between smooth paper and rough paper.

Accordingly, a plurality of heating conditions and fixing conditions or image forming conditions must be provided in conformity with the kinds of paper and for the changeover of these conditions, the user must select a mode suited for the paper used in conformity with that paper, and in such an image forming apparatus, this has led to the problem that when the user has made a mistake in setting or does not know that the kind of paper has been changed in a network printer, bad images due to the deficiency of heat treatment or the deficiency of the fixing property, density or the like may result, or conversely excessive heating may waste electric power and also may cause the bad images due to high temperature offset or the toner contamination of the fixing device, or excess developer may be consumed.

Also, in a method already proposed as a solution to the above-noted problem, wherein a metal plate having a piezoelectric element is made to frictionally contact with a recording material to thereby measure the difference in the roughness of the recording material as a difference in vibration intensity, and on the basis of the result thereof, the control of the heating temperature, the fixing temperature, the image forming conditions, etc. is changed over, the difference in vibration intensity cannot be sufficiently detected simply by making the tip end of a straight type metal plate frictionally contact the surface of the recording material, and practical discrimination between smooth paper and rough paper is impossible.

SUMMARY OF THE INVENTION

It is an object of the present invention to provide a surface discriminating device which does not require the recording material selection setting by a user and well discriminates the surface of a recording material even if a recording material having any surface roughness is used, and an image forming apparatus having the same.

It is another object of the present invention to provide a surface discriminating device having a probe and a piezoelectric element provided between the first end portion and second end portion of the probe, the probe having a fixed end portion and a second end portion capable of contacting with a recording material, wherein the probe contacts with and moves relative to the recording material to thereby scan the recording material, and the surface of the recording material is discriminated by an output from the piezoelectric element during the scanning of the recording material by the probe, and the probe has a bent portion, on the second end portion side thereof, and an image forming apparatus having the same.

Further objects of the present invention will become apparent from the following description.

DESCRIPTION OF THE PREFERRED EMBODIMENTS

Some embodiments of the present invention will hereinafter be described with reference to the accompanying drawings.

<Embodiment 1>

Figure 1A:
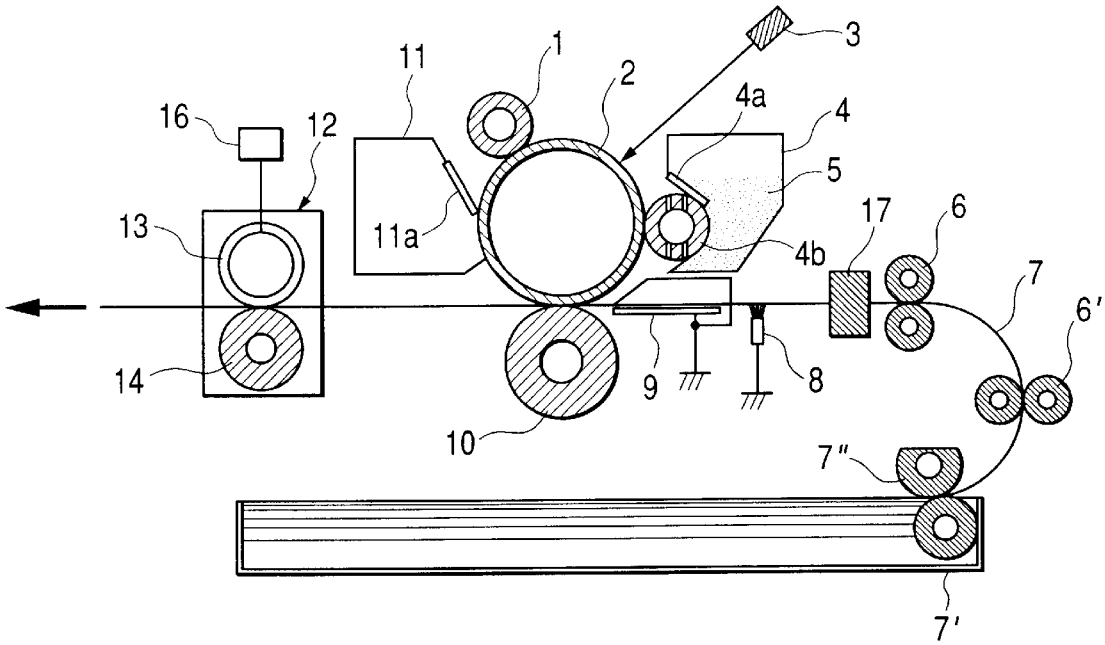
FIG. 1A is a cross-sectional view of an image forming apparatus which is an embodiment of the present invention.
Figure 1B:
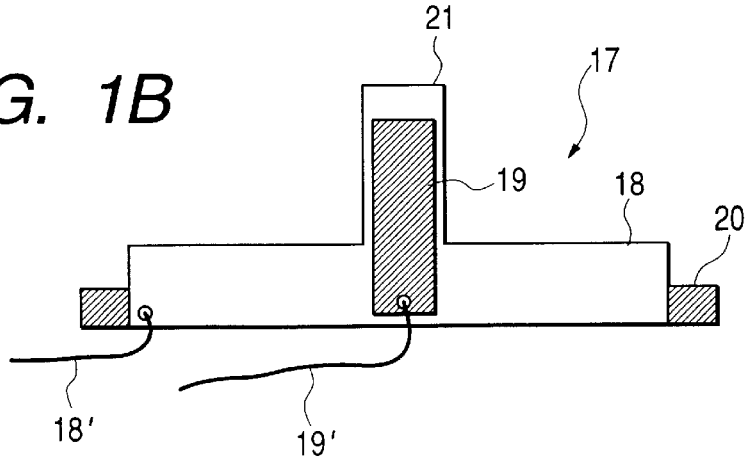
FIG. 1B is a top plan view of a surface roughness detecting device.
Figure 1C:
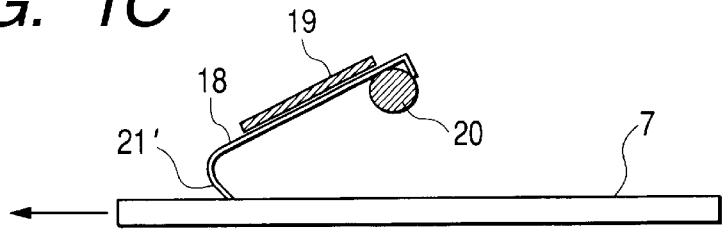
FIG. 1C is a cross-sectional view of the surface roughness detecting device.
Figure 2A:
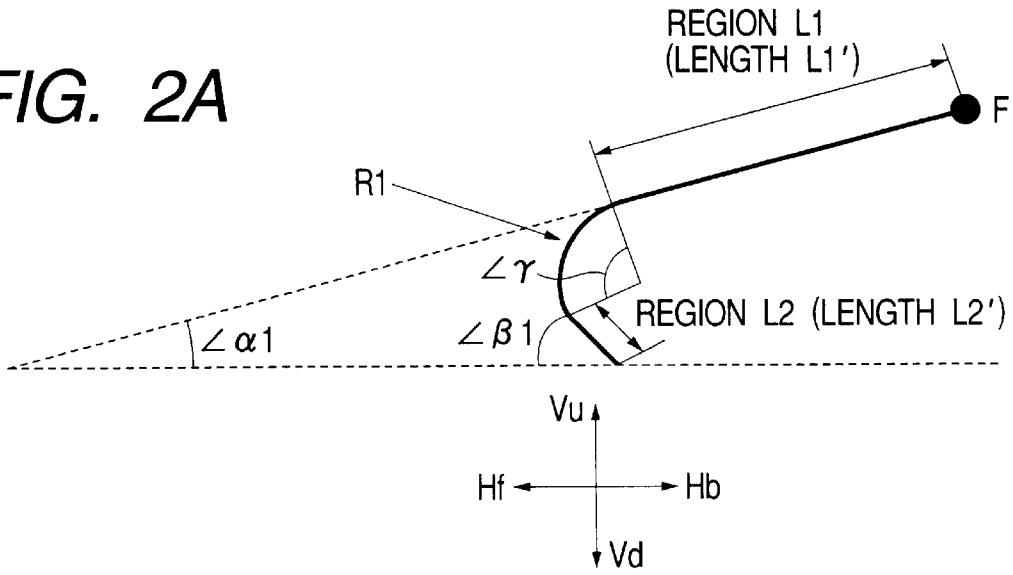
FIG. 2A is a cross-sectional view of the probe of a surface roughness detecting device according to Embodiment 1 of the present invention.
Figure 2B:
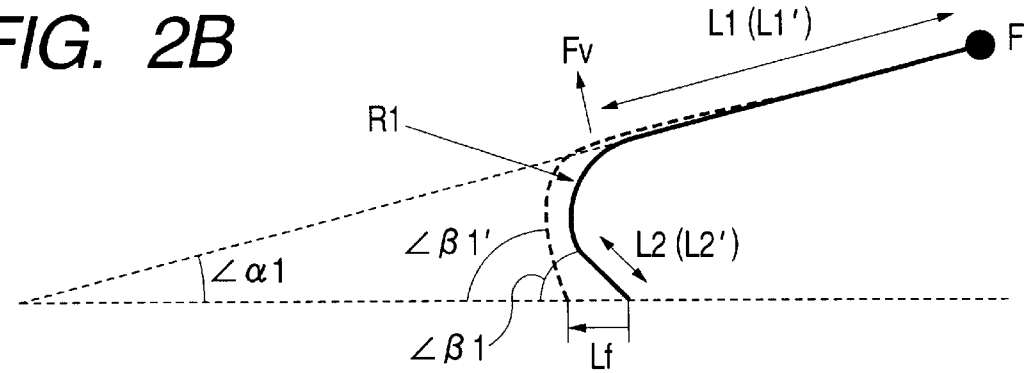
FIG. 2B is an illustration of the operation during probe scanning.
Figure 2C:
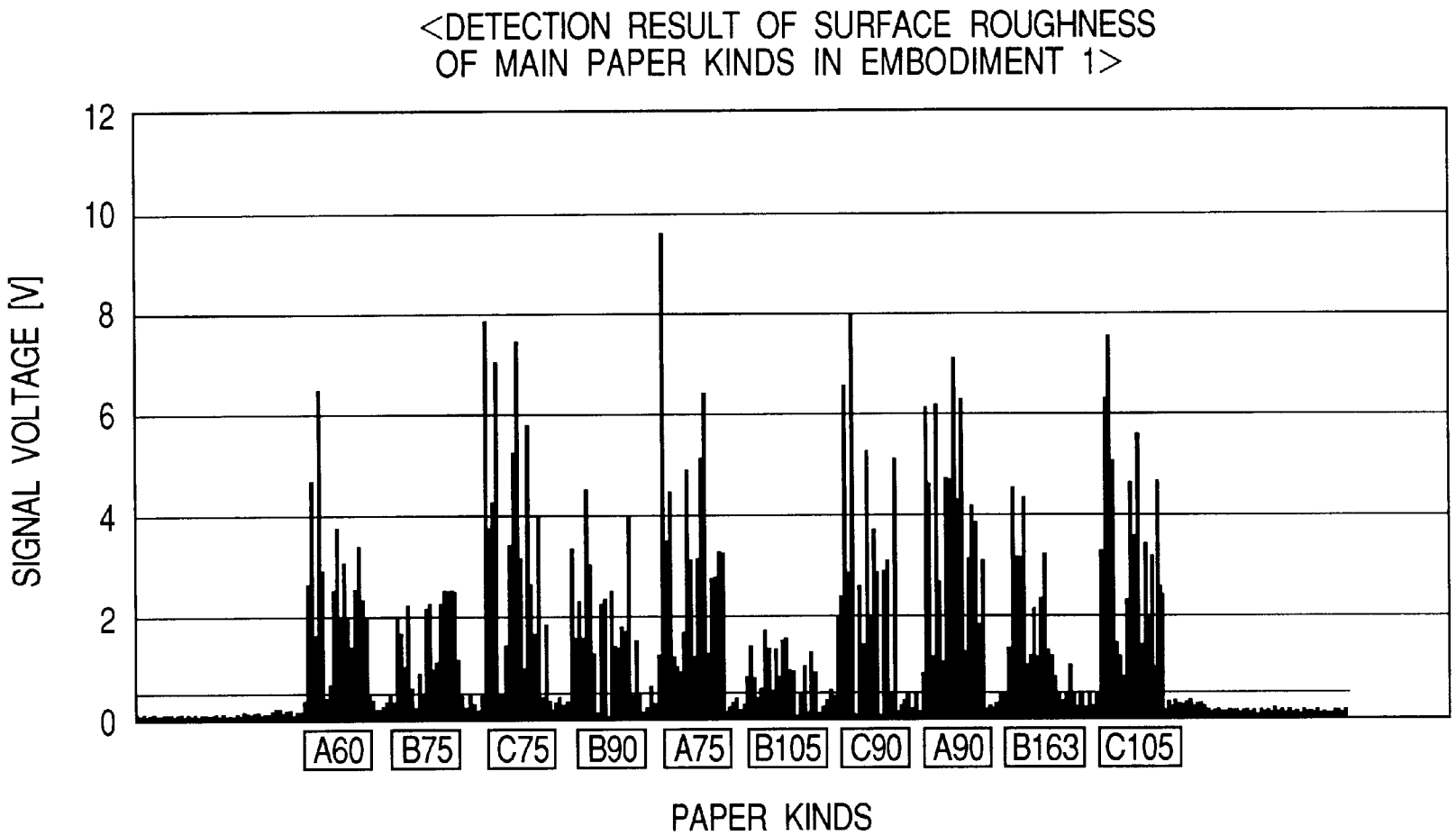
FIG. 2C is a comparison graph of the results of surface roughness detection.
Figure 3A:
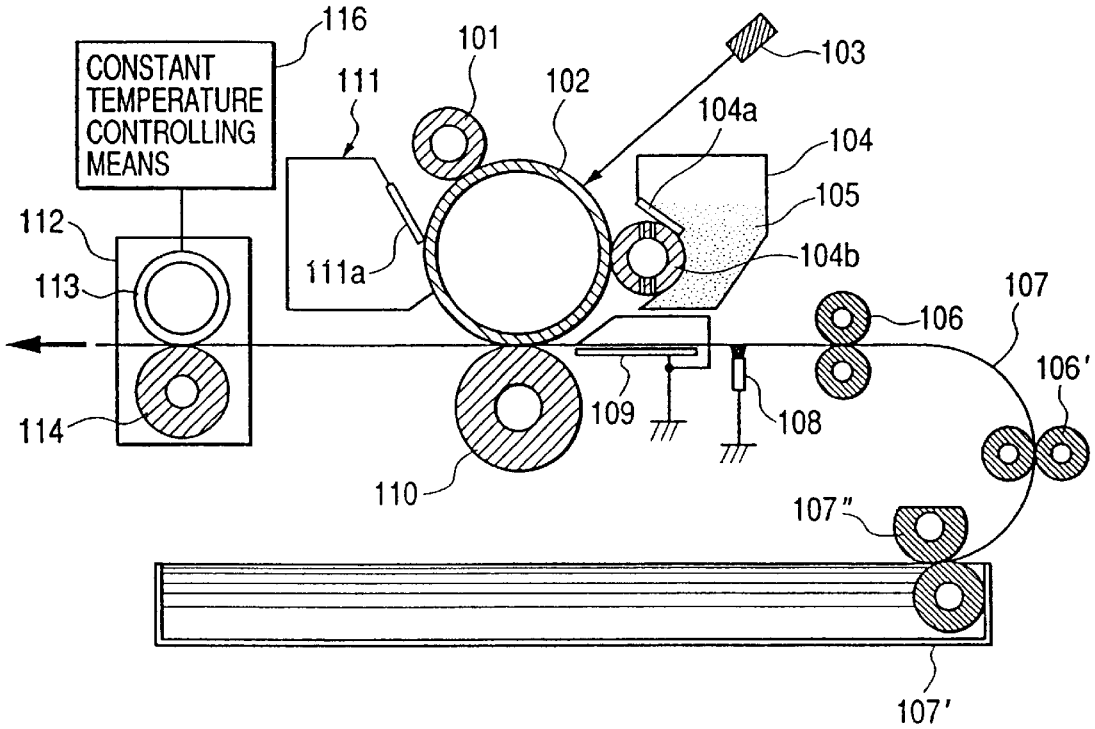
FIG. 3A PRIOR ART
FIG. 3A is a cross-sectional view of a conventional image forming apparatus.
Figure 3B:
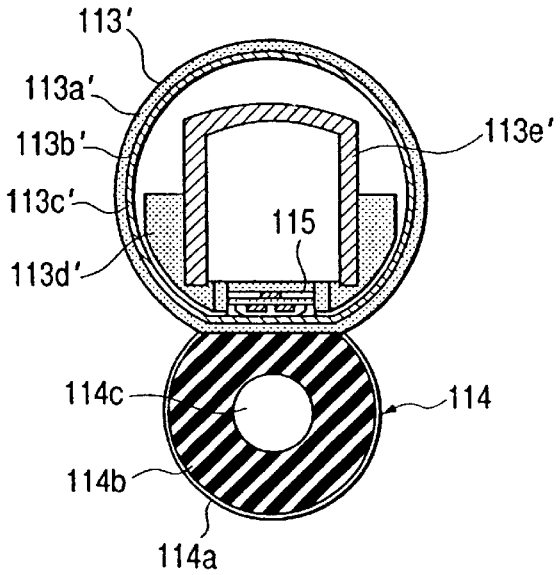
FIG. 3B PRIOR ART
FIG. 3B is a cross-sectional view of a conventional film heating fixing device.
Figure 3C:
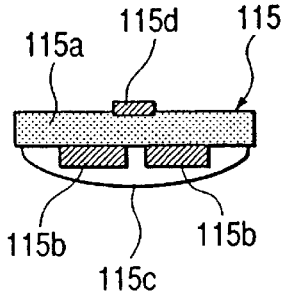
FIG. 3C PRIOR ART
FIG. 3C is a cross-sectional view of the heater of the conventional film heating fixing device.
Figure 4:
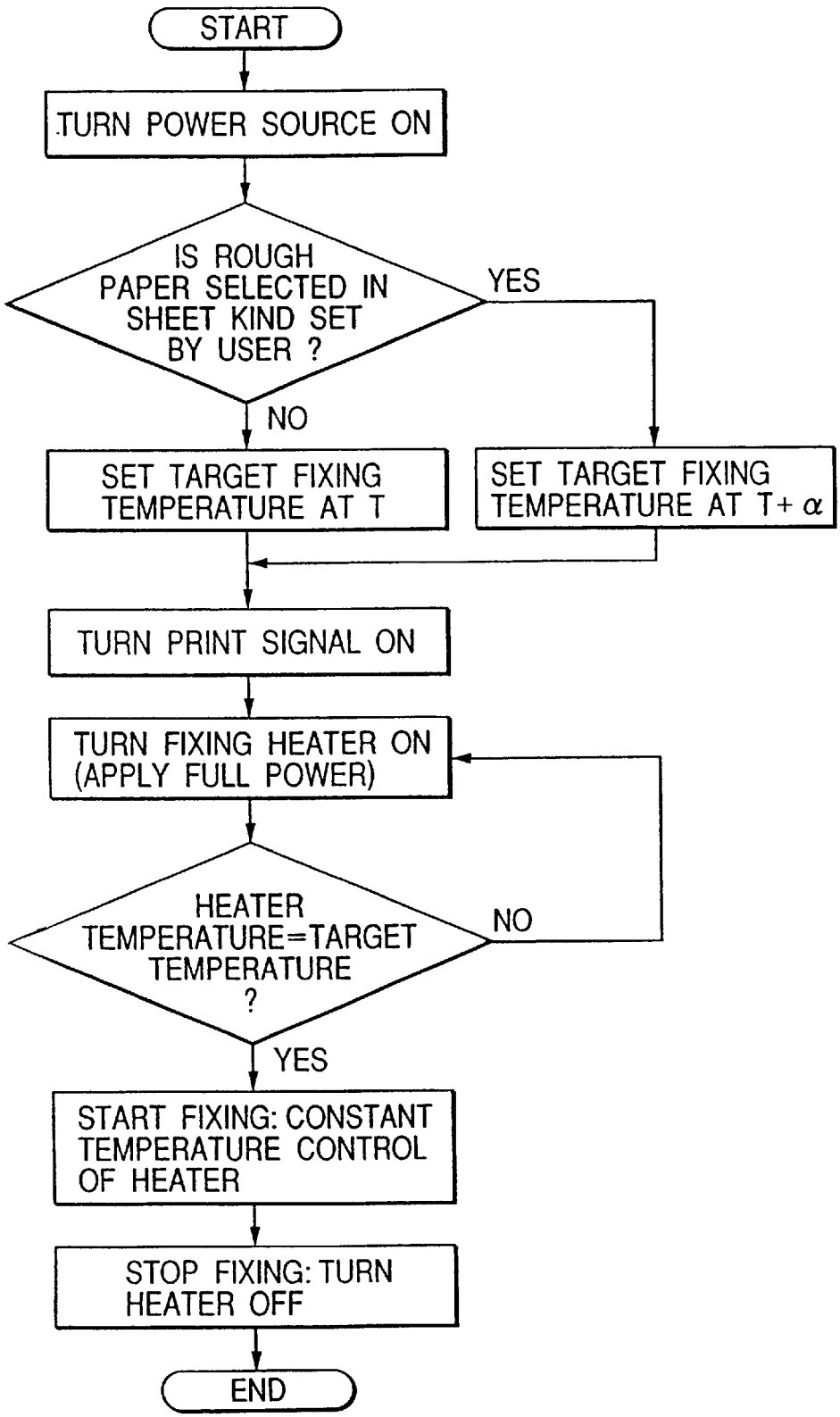
FIG. 4 PRIOR ART
FIG. 4 is a flowchart showing the conventional fixing controlling process.
Figure 5:
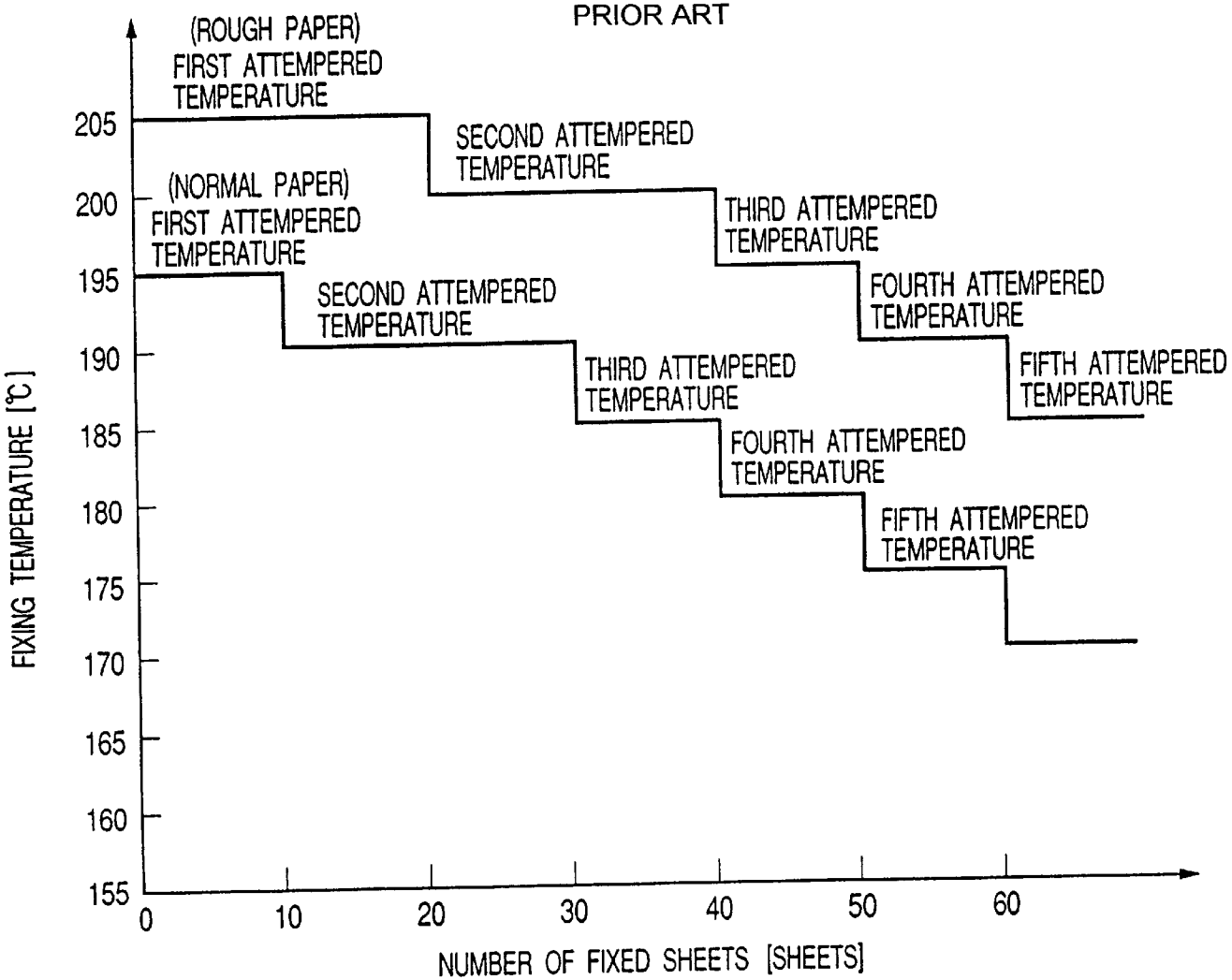
FIG. 5 PRIOR ART
FIG. 5 shows the changing of the conventional attempered setting by the kinds of paper and the number of supplied sheets.
Figure 6A:
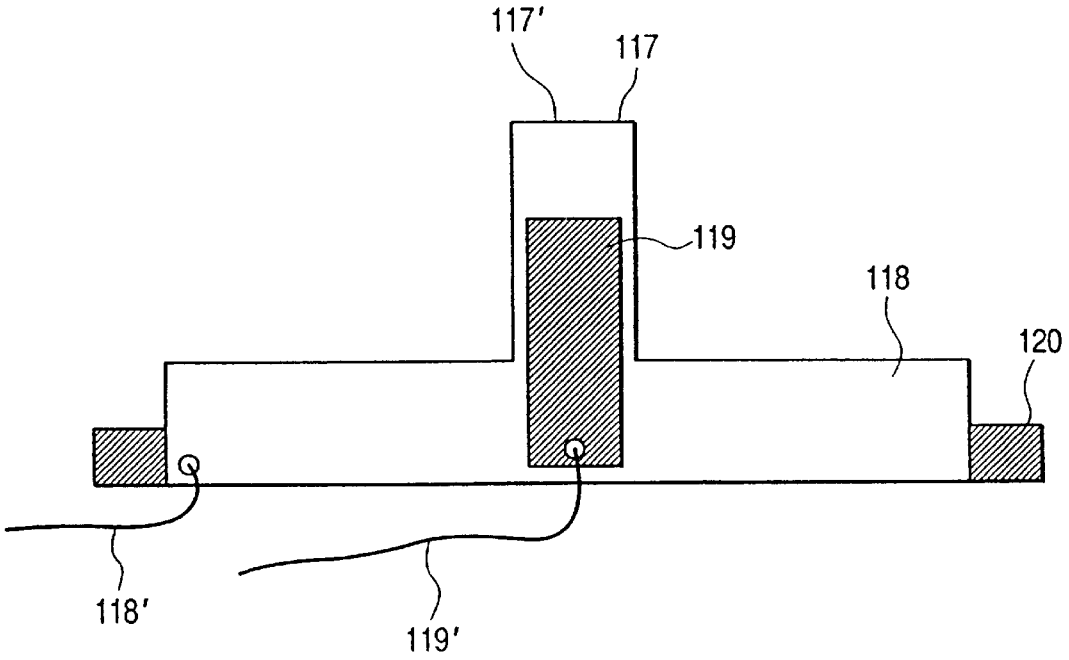
FIG. 6A PRIOR ART
FIG. 6A is a top plan view of a conventional surface roughness detecting device.
Figure 6B:
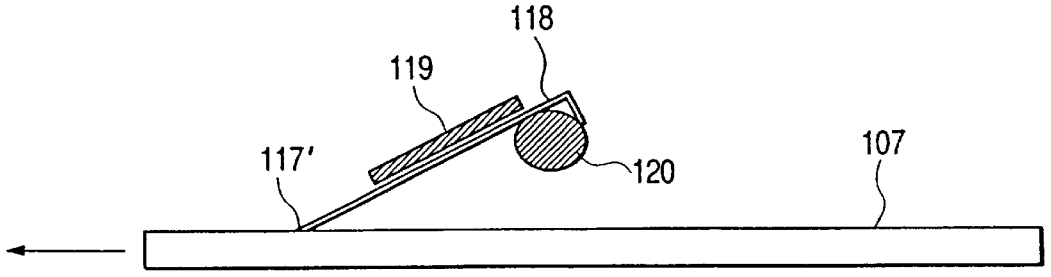
FIG. 6B PRIOR ART
FIG. 6B is a cross-sectional view of the detecting device.

FIGS. 1A, 1B and 1C and FIGS. 2A, 2B and 2C show Embodiment 1 of the present invention, FIG. 1A being a cross-sectional view of an image forming apparatus, FIG. 1B being a top plan view of a paper surface roughness detecting device, FIG. 1C being a cross-sectional view of the paper surface roughness detecting device, FIG. 2A being a cross-sectional view of the probe of the paper surface roughness detecting device, FIG. 2B being a cross-sectional view illustrating the operation during the probe scanning of the paper surface roughness detecting device, and FIG. 2C being a comparison graph of surface roughness detection.

Reference is first had to FIG. 1A to describe an image forming apparatus to which the present invention is applicable.

FIG. 1A is a cross-sectional view of the essential portions of a printer, and in the printer, the surface of a photosensitive drum 2 is uniformly charged to a predetermined polarity by a charging roller 1, whereafter charges are eliminated from only that area of the photosensitive drum 2 exposed by exposing means 3 such as a laser to thereby form a latent image on the photosensitive drum 2. The latent image is developed by a toner 5 in a developing device 4 and visualized as a toner image. That is, the toner 5 in the developing device 4 is frictionally charged to the same polarity as the charged surface of the photosensitive drum 2 between a developing blade 4*a* and a developing sleeve 4*b*, and a DC bias and an AC bias are superimposed and applied at a developing gap portion whereat the photosensitive drum 2 and the developing sleeve 4*b* are opposed to each other, and the toner 5 is caused to selectively adhere to the latent image forming portion of the photosensitive drum 2 by the action of an electric field while being suspended and vibrated, whereafter the toner 5 is carried to a transfer nip portion formed by a transferring roller 10 and the photosensitive drum 2 by the rotation of the photosensitive drum 2.

On the other hand, a recording material 7 such as paper on which an image is to be recorded has its leading edge fed from a recording material containing box 7' to a pair of vertically conveying rollers 6' by a pair of feed rollers 7", whereafter it is conveyed to ante-transfer conveying rollers 6 by the pair of vertically conveying rollers 6', and is further conveyed to the transfer nip portion along a transfer guide plate 9 at a prescribed angle of entry by the ante-transfer conveying rollers 6. During the time when the recording material 7 is conveyed from the ante-transfer conveying rollers 6 to the transfer nip portion, the surface of the recording material 7 may be charged by the frictional contact thereof with various members with which the recording material 7 contacts until it is conveyed to this area and therefore, a charge eliminating brush 8 for eliminating such unnecessary charges which will become a factor for disturbing the image when electrostatic recording is effected is provided so as to contact with the back side of the recording material 7 being conveyed, and is grounded.

In a transferring portion, a high voltage opposite in polarity to the toner 5 is applied to the transferring roller 10 on the back side of the recording material 7 to electrostatically attract the toner 5 on the photosensitive drum 2 and move it to the recording material 7 side, and the toner 5 is electrostatically attracted by the back side of the recording material 7 and the toner image is transferred to the recording material 7 and also, the back side of the recording material 7 is charged to a polarity opposite to that of the toner 5, and transferring charges for continuing to hold the transferred toner 5 are imparted to the back side of the recording material 7.

Lastly, the recording material 7 to which the toner image has been transferred is conveyed to a fixing device 12 comprised of a heating rotary member 13 and a pressure roller 14 forming a nip portion therewith, and is heated and pressurized while being controlled to a constant temperature by constant temperature controlling means 16 provided on the heating rotary member 13 side so as to maintain a fixing temperature preset at the nip portion, and the toner image is fixed.

Adhering substances such as the toner differing in polarity remain slightly on the surface of the photosensitive drum 2 after the transfer of the toner image therefrom and therefore, the surface of the photosensitive drum 2 after it has passed the transfer nip portion is cleaned by a cleaning container 11 by the adhering substances thereon being scraped off by a cleaning blade 11*a* counter-abutting against the surface of the photosensitive drum 2, whereafter the photosensitive drum 2 stands by in preparation for the next image formation.

In the present embodiment, a paper surface roughness detecting device 17 is provided downstream of the pair of ante-transfer recording material conveying rollers 6, as shown in FIG. 1A, and in the present embodiment, as the paper surface roughness detecting device 17, use is made of one of a construction as shown in FIG. 1B. The paper surface roughness detecting device 17 is comprised of a piezoelectric element 19 comprising piezoelectric ceramics such as PZT of a thickness 0.2 mm and a size of 4.8 mm at the center between the fixed end (first end portion) and the distal end (second end portion) of a T-shaped metal plate (probe) 18 made of SUS which is a resilient member of a thickness 0.15 mm fixed to a rotatable rotary shaft 20, and a plus side signal line 19' and a minus side signal line 18' for soldering the piezoelectric element 19 to the surface of the metal plate 18 and electrically connecting it to a measuring system (not shown) and uses a J-shaped cross section sensor 21 having a J-shaped (or L-shaped) cross-sectional shape as shown in FIG. 1C. That is, a bent portion is provided in the cross-sectional shape of a probe as it is seen from a cross section perpendicular to a scanning surface and parallel to a scanning direction.

The probe contacts with the recording material and is moved relative thereto to thereby scan the recording material, and the surface of the recording material is discriminated by an output from the piezoelectric element during the scanning of the recording material by the probe.

In the present embodiment, the paper surface roughness detecting device is fixed and the recording material is moved, whereby the scanning of the recording material is effected.

In the present embodiment, as shown in FIG. 1C, the fixed end of the sensor 21 is disposed downstream of the tip end abutting portion with respect to the scanning direction (upstream with respect to the direction of movement of the recording material) and thus, the tip end portion of the sensor 21 is constituted by a J-shaped opposite direction abutting tip end 21' abutting in a direction opposite to the direction of movement of the recording material, and the details of each portion are such that as shown in the cross-sectional view of FIG. 2A, the piezoelectric element forming area is defined as L1, the radius of curvature of the bent portion is defined as R1 and the area from the bent portion to the tip end abutting portion of the sensor 21 is defined as L2, and the length (L2') of the area L2 is set so as to be shorter than the length (L1') of the area L1.

Specifically, L1' from the fixed end F to the bent portion is 15 mm, L2' is 1.5 mm, the radius of curvature R1 is 1.5 mm, the central angle thereof $\angle\gamma=90°$, the set angle difference of L1 relative to the scanning plane is $\angle\alpha 1=30°$, and the set angle of L2 is $\angle\beta 1=60°$, and the abutting angle of the tip end portion of the sensor 21 is set in such a counter direction that the tip end portion bites into the surface of the paper in an opposite direction (in the present embodiment, opposite to the conveying direction of the paper) to the scanning direction, whereby any delicate difference in paper surface roughness is detectable at relatively light abutting pressure, and in fact, a pressure force of 3–30 gram-weight by pressurizing means, not shown, which will not hamper the conveyance of the paper or will not damage the surface of the paper (in the present embodiment, one end of a coil spring mounted on a rotary shaft is fixed to the housing of the apparatus and the other end thereof is attached to a metal plate on the tip end side, but use may also be made of a weight acting equally thereto), is sufficient as the abutting pressure, and in the present embodiment, the setting of 10 gram-weight is used, and such a construction settable at relatively light pressure is advantageous from the viewpoint of the durability of the sensor 21 itself.

When the tip end portion of the sensor is made to abut against the surface of the paper in this manner, if a minute projection such as a burr created when the sensor metal plate is made by a manufacturing method such as punching is present on the abutting tip end portion, the fiber of the surface of the paper will be hooked on this projection, and even if the paper is originally smooth paper, the tip end portion of the sensor will be deformed as in the case of rough paper and a signal approximate to that in the case of rough paper will be produced.

On the other hand, even if a sensor having such a minute projection is used for rough paper, originally the signal level is high and therefore a very great change in the level will not occur and as a result, there is the danger that the discrimination signal difference between rough paper and smooth paper decreases and discrimination effectiveness is lowered. Therefore, in the present embodiment, the tip end portion of this sensor is subjected to the polishing process for removing the burr and at the same time, the right and left corners of the tip end portion are subjected to the rounding process of a radius 0.5 mm so that even if the tip end portion of the sensor abuts against the paper while being inclined to right or left due to some factor, the sharp corner will not hook the fiber of the surface of the paper and no abnormal signal will be produced.

FIG. 2B shows changes in the cross-sectional shape of the sensor when the surface of the paper was scanned by the thus set J-shaped sensor, and when the tip end portion of the sensor is pushed to the downstream side by a distance Lf by the surface of the paper moving in the direction of arrow from right to left, a portion comprised of L2 and R1 has higher rigidity than the rigidity of a portion L1 by the shortness of its shorter side and the action of the curved structure thereof and therefore, the amount of deformation of this L2 and R1 portion is relatively small and the angle of the abutting portion rises from $\angle\beta 1$ to an obtuse angle $\angle\beta 1'$ while this portion maintains substantially the same shape and thus, with this change, the unfixed end of L1 is raised with a force Fv in a direction opposing the pressurizing direction of the sensor.

As a result, warp deformation in a downwardly convex direction is induced in the portion L1 and further, the curved structure is widened in a direction in which the curvature of R1 becomes loose (the radius of curvature increases) while the tip end portion of the sensor continues to be pushed to the downstream side, and with this deformation, a force of restitution which tries to restore this deformation to the original shape is accumulated in the metal plate at a rate proportional to the springiness of the metal plate itself, and together with the action of the pressure force of the pressurizing means (not shown), this acts to push the tip end portion back to its original position, at the moment when this force of restitution exceeds the allowable amount of deformation of the sensor by the conveying force of the paper, the tip end portion of the sensor begins to slide on the surface of the paper in the scanning direction, and tries to return to its original position while being leapt up by the frictional contact thereof with the surface of the paper.

Here, the tip end portion of the sensor is once returned to the upstream side of its original position by the inertia thereof, whereafter it repeats the aforedescribed step again and as a result, each time it is returned to its original position, vibration including a shock by the collision thereof against the surface of the paper is created in the tip end portion of the sensor, and in the meantime, the shock is also transmitted to the portion L1 and warp in both of the upward and downward directions is repeated and the portion L1 comes to be vibrated and therefore, distortion by the shock and deformation is created in the piezoelectric element formed in this portion L1 and a sufficient electromotive force comes to be generated, and there is obtained an electrical signal vibrating in the shape of a pulse. At this time, the intensity of these vibrations is proportional to the strength with which the paper can push the tip end portion of the sensor and greatly deform the portion L1, and the intensity of this force with which the paper pushes the tip end portion of the sensor is proportional to the difference between frictional forces acting on the surface of the paper and the tip end portion of the sensor and therefore, rough paper having a rough surface can create stronger vibration in the sensor than smooth paper.

Thus, by so setting the sensor and scanning sheets of paper differing in surface roughness from each other to thereby compare the intensity differences of electrical signals obtained from the piezoelectric element, it becomes possible to discriminate the surface roughness of the paper.

Figure 7A:
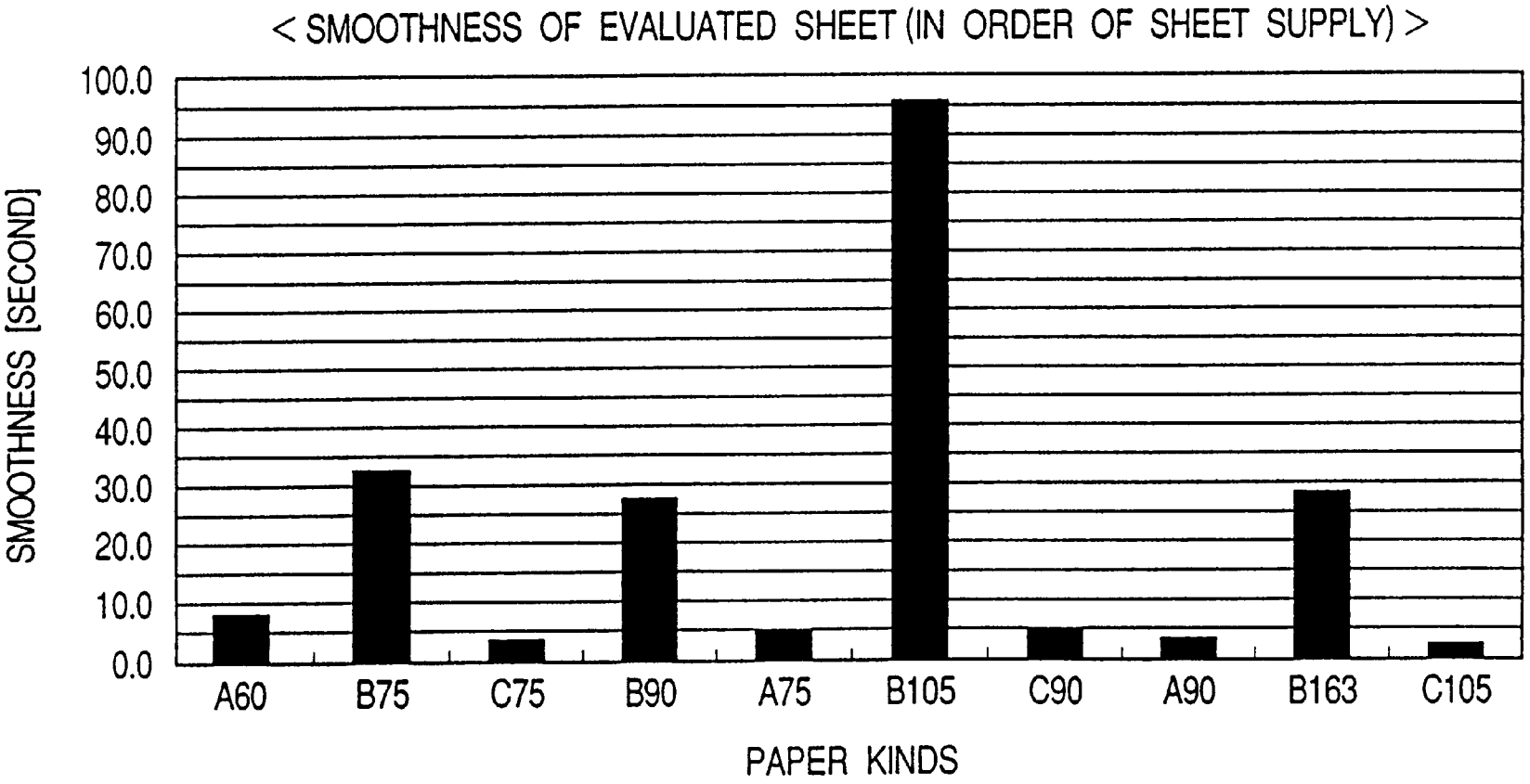
FIG. 7A PRIOR ART
FIG. 7A is a comparison graph of the smoothness of evaluated sheets.
Figure 7B:
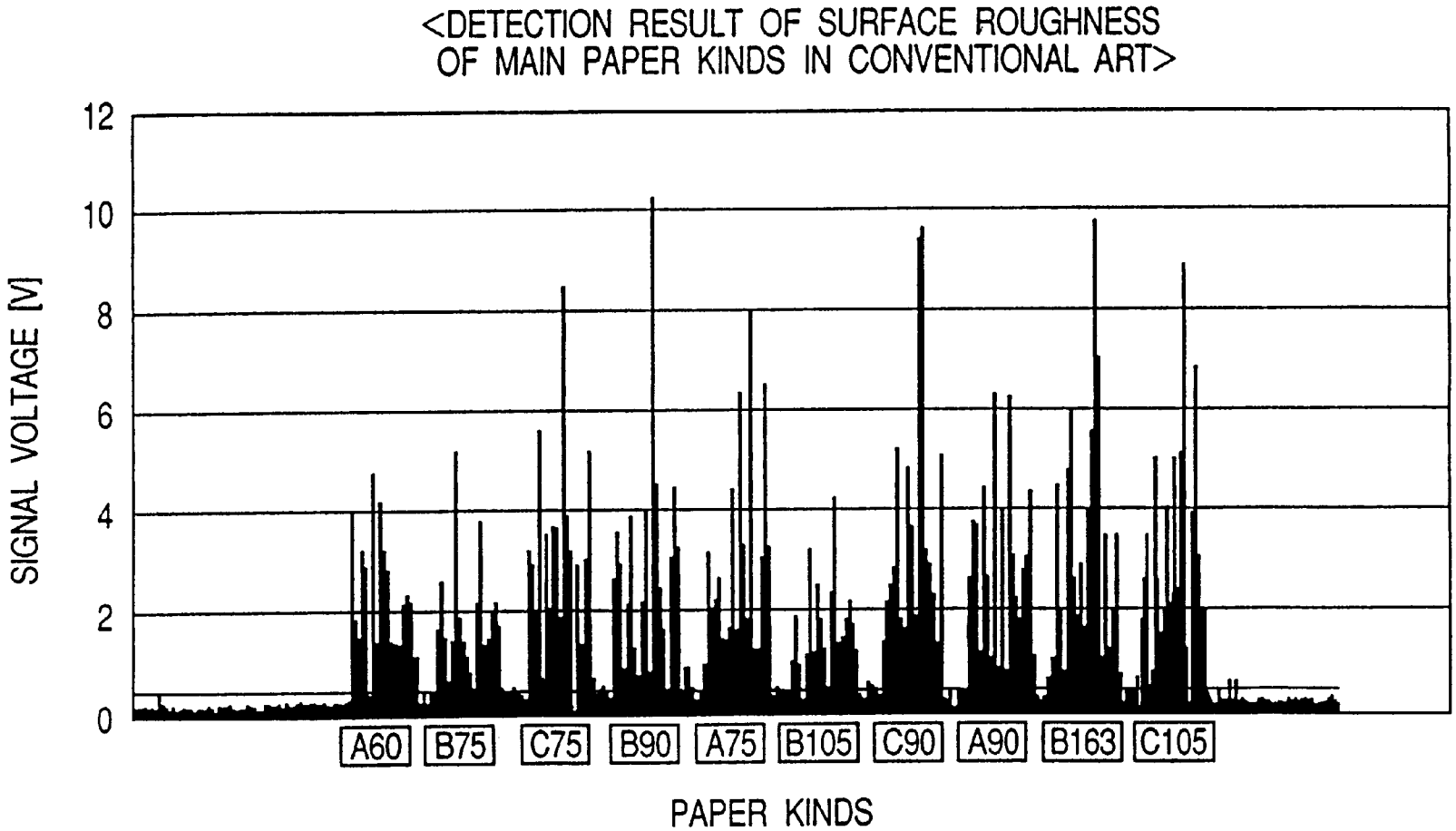
FIG. 7B PRIOR ART
FIG. 7B is a comparison graph of the results of surface roughness detection using the conventional surface roughness detecting device.

The graph of FIG. 2C shows the result of the evaluation made by the use of the above described construction with sheets of paper having the same smoothness as that in FIG. 7A being supplied in the same order as in FIG. 7A, and clearly as compared with the graph of the example of the conventional art, the differences in the signal intensity corresponding to the smoothness of paper and the density thereof are actualized, and there comes to be obtained the tendency that a signal of low intensity and low density is produced for paper of high smoothness and a signal of high intensity and high density is produced for paper of low smoothness, and it has been found that by applying electrical signal processing (not shown) for emphasizing these differences, it becomes possible to give a discrimination signal having a sufficiently discriminable level difference to a CPU (not shown) used in the control of the apparatus.

The difference between the conventional construction and the construction according to the present embodiment lies in that the present sensor has curved structure in which the tip end portion of the sensor is bent and by the utilization of this curvature, the tip end portion is made capable of counter-abutting with respect to the direction of movement of the recording material, and by this structural feature, displacement in the scanning direction can be mechanically efficiently converted into displacement in a direction perpendicular to the piezoelectric element forming surface (an electromotive force generating direction) and therefore, the minute concavo-convexity difference on the surface of the paper is made convertible into a great vibration intensity difference and discriminability is enhanced, and the above-described effect cannot be obtained simply by causing the distal end portion of a flat metal plate formed with a piezoelectric element to abut against the surface of paper as in the conventional art. If an attempt is made to make a paper conveyance resisting force in the scanning direction act on the element forming surface in the electromotive force generating direction by the conventional construction, it is necessary for that purpose to set the entire sensor at an angle perpendicular as far as possible to the scanning surface, and in that case, the paper conveyability is hindered and further, the acting direction of a pressure force for holding down the sensor and the acting direction of paper conveyance are no longer in mutually repulsing relationship and therefore, the pressure force does not act in a restoring direction, but the sensor must be vibrated by the force of restitution by the springiness of the metal plate itself and a sufficient vibration intensity difference becomes unobtainable, and the discriminability also becomes insufficient.

Also, in the foregoing content, only the vibration intensity difference is the object of evaluation, but when it is possible to provide a frequency analyzing circuit in the interior of the apparatus, the frequency analysis of the output signal of the present sensor for each sheet of paper is effected to thereby compare a frequency spectrum waveform differing from paper to paper, whereby it is possible to discriminate the surface roughness of paper. As the simplest example, in the sensor of the shape and size of the present embodiment, the main resonance frequency exists in the vicinity of 500 Hz, and around this resonance frequency, there is the difference in tendency that for rough paper, the rising of the spectrum waveform becomes remarkable, whereas in the case of smooth paper, a substantially flat waveform remains unchanged.

From the viewpoint of the influence upon the above-mentioned conveyability of paper, even in the construction of the present embodiment, if the leading edge portion of the paper is intactly conveyed to the tip end portion of the sensor, the paper will be caught up by the curve of the distal end of the metal plate facing in the counter direction and jam will be caused easily. Therefore, in the construction of the present embodiment, provision is made of sensor tip end spacing means (not shown) for causing the tip end portion of the sensor to stand by in a state in which it is spaced apart above from the paper conveying surface by 5 mm with the rotary support shaft as the center of rotation, and lowering it to the surface of the paper after the leading edge of the paper has passed the detecting position, and the sequence is such that after by this means, the tip end of the sensor has been brought into contact with the surface of the paper, a signal is read out.

The present sensor having the above-described feature is provided at a location indicated in FIG. 1A in the laser beam printer of the electrophotographic type according to the present embodiment, whereby the printer becomes capable of automatically judging the surface roughness of the paper used and effecting fixing at a fixing temperature conforming to each surface roughness and in the temperature attempering changeover sequence during continuous paper supply and therefore, it is possible to save the trouble for the user to discriminate paper and select a fixing temperature suited for each paper and the temperature attempering changeover sequence during continuous paper supply, as in the conventional art, and to prevent the occurrence of such an inconvenience that an inappropriate fixing condition is selected by the user's wrong judgment and the image after fixing becomes deficiently fixed.

Further, in the conventional apparatus, it is not desired to cause the user to frequently take the trouble to change over the fixing condition and therefore, the temperature has been set somewhat higher than a necessary and sufficient fixing temperature for original smooth paper so that a certain degree of rough paper can be fixed under the same condition as for smooth paper higher in frequency of use (that is, so that deficient fixing may not result even if use is made of such rough paper that the user cannot clearly recognize it as rough paper when usually smooth paper is used), but this has not been preferable from the viewpoint of energy saving in that even when smooth paper generally high in the frequency of use is to be fixed, more than necessary heat energy has always been consumed.

However, when the present sensor is mounted on this apparatus and is made to automatically discriminate, it becomes possible to fix smooth paper at a necessary sufficient optimum fixing temperature, and fix somewhat rough paper at a necessary sufficient optimum fixing temperature for that paper and therefore, it becomes possible to save heat energy consumed extra for smooth paper most used hitherto, and considering the influence of this difference on the worldwide scale, it also becomes possible to obtain a large-scale energy-saving effect.

As methods of changing over the fixing condition by the use of the present sensor, the following methods would occur to mind.

(A) A method of setting a threshold value for paper simply classified into two values, i.e., rough and smooth.

In this case, in the initial state in which the kind of paper is unknown, the temperature setting for fixing rough paper is effected, and after the detection by the sensor, rough paper is preferentially handled in such a manner as (A-1) to execute, when the paper is judged to be rough paper, fixing at the intact fixing temperature and the temperature attempering sequence for continuous sheet supply, and (A-2) to lower the fixing temperature to a temperature for fixing smooth paper when the paper is judged to be smooth paper, and change over the temperature attempering sequence for continuous sheet supply to the sequence for fixing smooth paper, whereby the danger of fixing rough paper at a low temperature due to wrong detection in the worst case and forming a badly fixed image can be avoided, and also in respect of the reaction speed, to set a low temperature at first, and then raise it to a necessary temperature after the sensor has detected the paper as rough paper, much time may be taken and the performance may be reduced and therefore, it is more advantageous to set as described above.

On the other hand, even if smooth paper is wrongly detected as rough paper, damage can be restricted to such a degree that energy will be consumed extra only for a short time from the initial stage of the printing operation till the point of time of the detection by the present sensor.

(B) A method of providing a plurality of threshold values for classifying roughness into a plurality of stages.

For example, when surface roughness is classified into three stages, i.e., "smooth, rough and very rough", (B-1) For smooth and rough, set as described in (A) above;

(B-2) Only when the paper is detected as being very rough, the fixing temperature is changed over to a still higher exclusive temperature, and the temperature attempering sequence for continuous sheet supply is also changed over to an exclusive sequence (or the fixing speed and the throughput are reduced).

Thereby, it becomes unnecessary to handle very rough paper at the initially set fixing temperature in the state described in (A) above in which the kind of paper is unknown and therefore, the energy consumed in the meantime and the energy consumed for the fixing of rough paper can be further saved, and the fixing of very rough paper can also be sufficiently secured. In this method, besides this, by adding the classification "very smooth" to special paper having a very smooth surface and a resin sheet such as an OHP sheet, fixing at a low temperature becomes possible for paper of this kind, and the saving of energy can be further expedited.

Also, particularly for smooth resin sheets, the heat transfer, absorption and insulation properties are too good and therefore, if the apparatus is made higher in speed by the conventional construction, there has been the danger that when the resin sheets are continuously fixed, it becomes easy for them to maintain a high temperature on a discharge tray after the fixing and moreover, the time for sufficiently cooling them becomes null, and when the continuously fixed sheets are superposed one upon another, toner images formed on the surfaces thereof are fused, thus resulting in the inconvenience that the sheets are coupled together, but by the setting according to the present method, necessary minimum low temperature fixing becomes possible also for the sheets of this kind and therefore, the occurrence of the inconvenience of this kind can also be prevented.

(C) A method of directly classifying roughness.

The method (B) is further developed and no particular threshold value is provided, and an obtained detection signal is substituted for predetermined control to thereby control finely.

As the changeover methods there are the foregoing methods, and the less detailed the classification is made, the more the cost can be reduced and the more the reliability can be improved, while on the other hand, the more detailed the classification becomes, the more the above-described energy-saving effect can be enhanced.

<Embodiment 2>

Figure 8A:
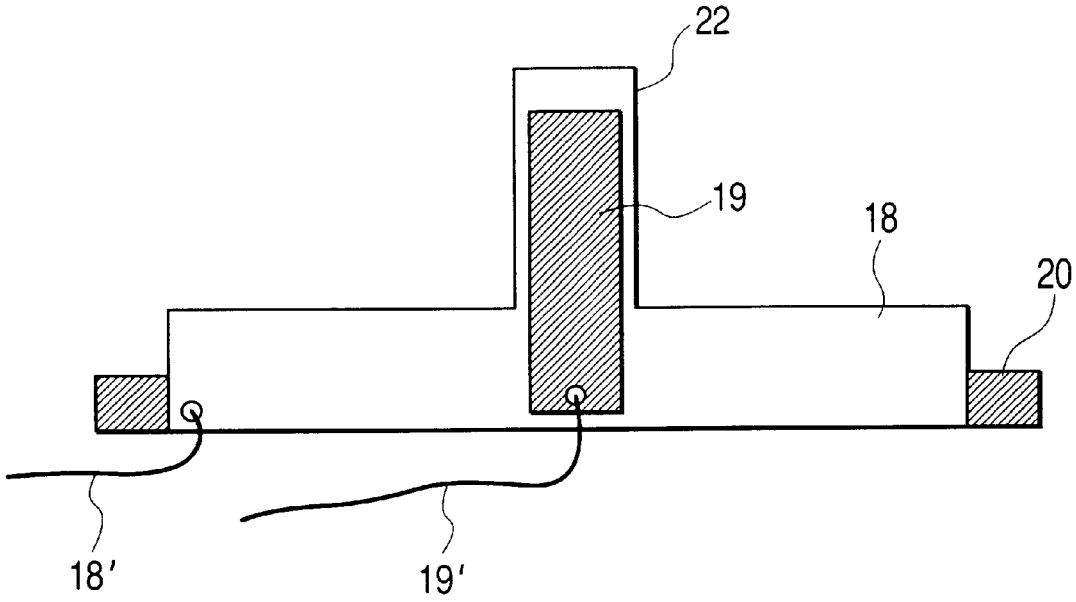
FIG. 8A is a top plan view of a surface roughness detecting device according to Embodiment 2 of the present invention.
Figure 8B:
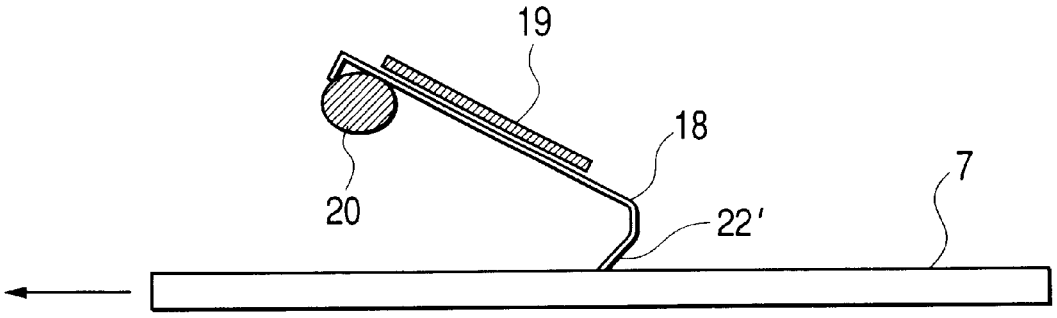
FIG. 8B is a cross-sectional view of the surface roughness detecting device.
Figure 9A:
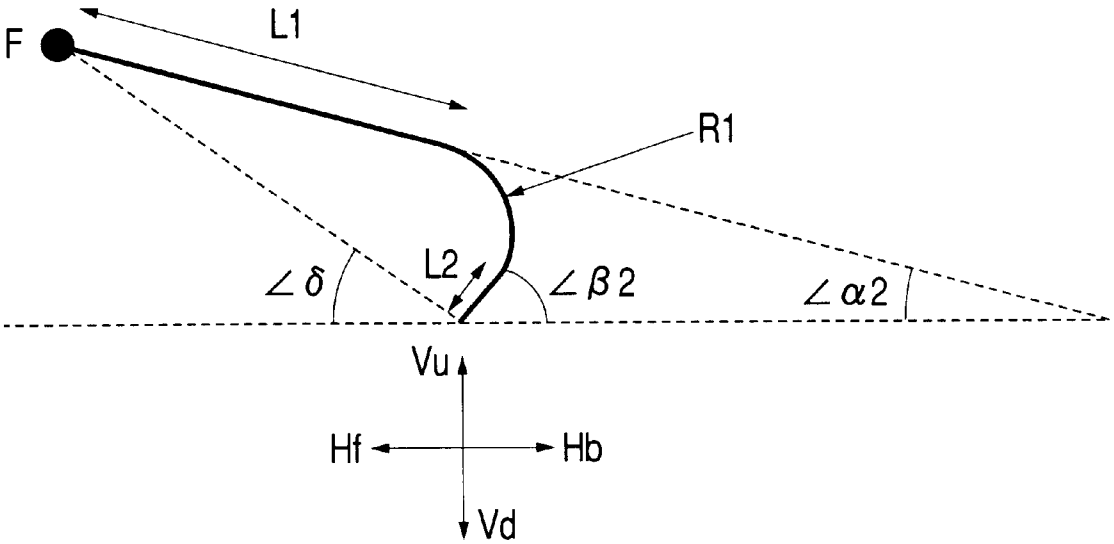
FIG. 9A is a cross-sectional view of the probe of the surface roughness detecting device according to Embodiment 2 of the present invention.
Figure 9B:
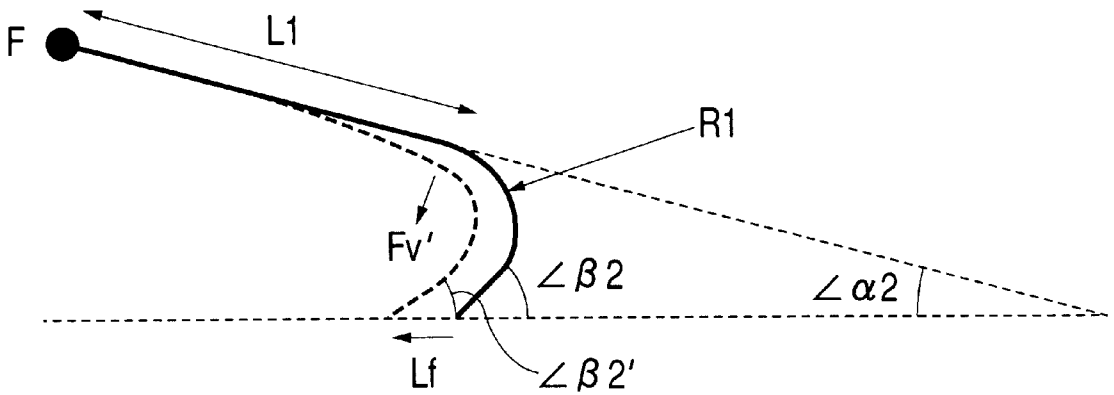
FIG. 9B is an illustration of the operation during the scanning by the probe.

FIGS. 8A and 8B and FIGS. 9A and 9B show Embodiment 2 of the present invention, FIG. 8A being a top plan view of a paper surface roughness detecting device, FIG. 8B being a cross-sectional view of the paper surface roughness detecting device, FIG. 9A being a cross-sectional view illustrating the operation during the probe scanning of the paper surface roughness detecting device, and FIG. 9B being a surface roughness detection comparison graph.

In FIG. 8A, the same elements as those shown in FIG. 1B are given the same reference numerals, and in the present embodiment, as shown in FIG. 8A, use is made of a sensor of substantially the same shape as the sensor in Embodiment 1, and as shown in FIG. 8B, the setting direction of the entire sensor is reversed, and use is made of a counter-set J-shaped cross section sensor 22 having its fixed end disposed on the upstream side with respect to the scanning direction (the downstream side with respect to the direction of movement of the recording material) and having its tip end abutting portion disposed on the downstream side, and by this setting, the tip end portion of the sensor is constituted by a J-shaped forward direction abutting tip end 22' abutting in a forward direction relative to the direction of movement of the recording material.

The detailed dimension and angle of each portion of the present sensor 22 are similar to those in Embodiment 1, but the setting direction is reverse and therefore, as shown in FIG. 9A, judging from only the tip end portion, the tip end portion of the sensor is in its abutting state in the forward direction relative to the direction of movement of the recording material and the set angle difference of L1 relative to the scanning plane is $\angle\alpha 2$. At this abutting angle of the tip end portion of the sensor, as in Embodiment 1, there is caused such action that the tip end portion bites into the surface of paper relative to an opposite direction to the scanning direction (in the present embodiment, the conveying direction of paper) and therefore, in the present embodiment, the abutting angle of the entire sensor 22 is set so that the angle $\angle\delta$ formed by a straight line linking the fixed end portion and tip end portion of the sensor 22 together and the downstream side scanning plane may satisfy the condition that $\angle\delta<90°$, and if at this setting, the upstream side corner of the distal end portion of a metal plate pressurized in a clockwise direction of rotation about the rotary shaft of the fixed end portion becomes capable of scanning while biting into the surface of the paper, and the minute concavo-convexity difference of the surface of the paper is detectable accurately and with relatively light abutting pressure, and in fact, the abutting pressure is set to the same 10 g as in Embodiment 1, but the tip end portion of the sensor does not damage the surface of the paper (the surface of the tip end portion is polished as in Embodiment 1) and can secure a sufficient detection signal level, and this construction is advantageous also from the viewpoint of the durability of the sensor 22 itself.

FIG. 9B shows changes in the cross-sectional shape of the sensor when the surface of the paper was scanned by the thus set J-shaped sensor 22, and when the tip end portion of the sensor is pushed by a distance Lf toward the downstream side by the surface of the paper moving in the direction of arrow from right to left, a portion comprised of L2 and R1 has higher rigidity than the rigidity of a portion L1 due to the shortness of the short side thereof and the action of the curved structure thereof and therefore, the amount of deformation of the L2 and R1 portion is relatively small, and the angle of the abutting portion sinks from $\angle\beta 2$ to a more acute angle $\angle\beta 2'$ while maintaining substantially the same shape and therefore, with this change, the counter-fixed end side of L1 is pulled down in the direction of arrow with a force Fv' in the pressurizing direction of the sensor 22. As a result, warp deformation in an upwardly convex direction is induced in the portion L1 and further, the curved structure is shrunk in a direction in which the curvature of R1 becomes greater (the radius of curvature decreases) while the tip end portion of the sensor continues to be pushed to the downstream side, but with this deformation, a force of restitution which tries to restore this deformation to the original state is accumulated in the metal plate at a rate proportional to the springiness of the metal plate itself and acts to push the tip end portion back to its original position, and at the moment when this force of restitution has exceeded the allowable amount of deformation of the sensor 22 by the conveying force of the paper, the tip end portion of the sensor begins to slide on the surface of the paper in the scanning direction, and tries to return to its original position while being leapt up by the frictional contact thereof with the surface of the paper.

Here, the tip end portion of the sensor is once returned to the upstream side of its original position by inertia, whereafter the above-described process is repeated and as a result, in the tip end portion of the sensor, there is created vibration including the shock by the collision thereof against the surface of the paper each time the tip end portion is returned to its original position, and in the meantime, the shock is also transmitted to the portion L1 and the portion L1 repeats warping in both of the upward and downward directions and comes to vibrate and therefore, distortion due to the shock and deformation is created in a piezoelectric element formed on this portion L1 and a sufficient electromotive force comes to be generated, and there is obtained an electrical signal vibrating in the shape of a pulse, and on the basis of a principle similar to that in the case of Embodiment 1, the sensor 22 is thus set and scans sheets of paper differing in surface roughness, and the intensity difference between electrical signals obtained thereby from the piezoelectric element is compared, whereby it becomes possible to discriminate the surface roughness of the paper.

Figure 9C:
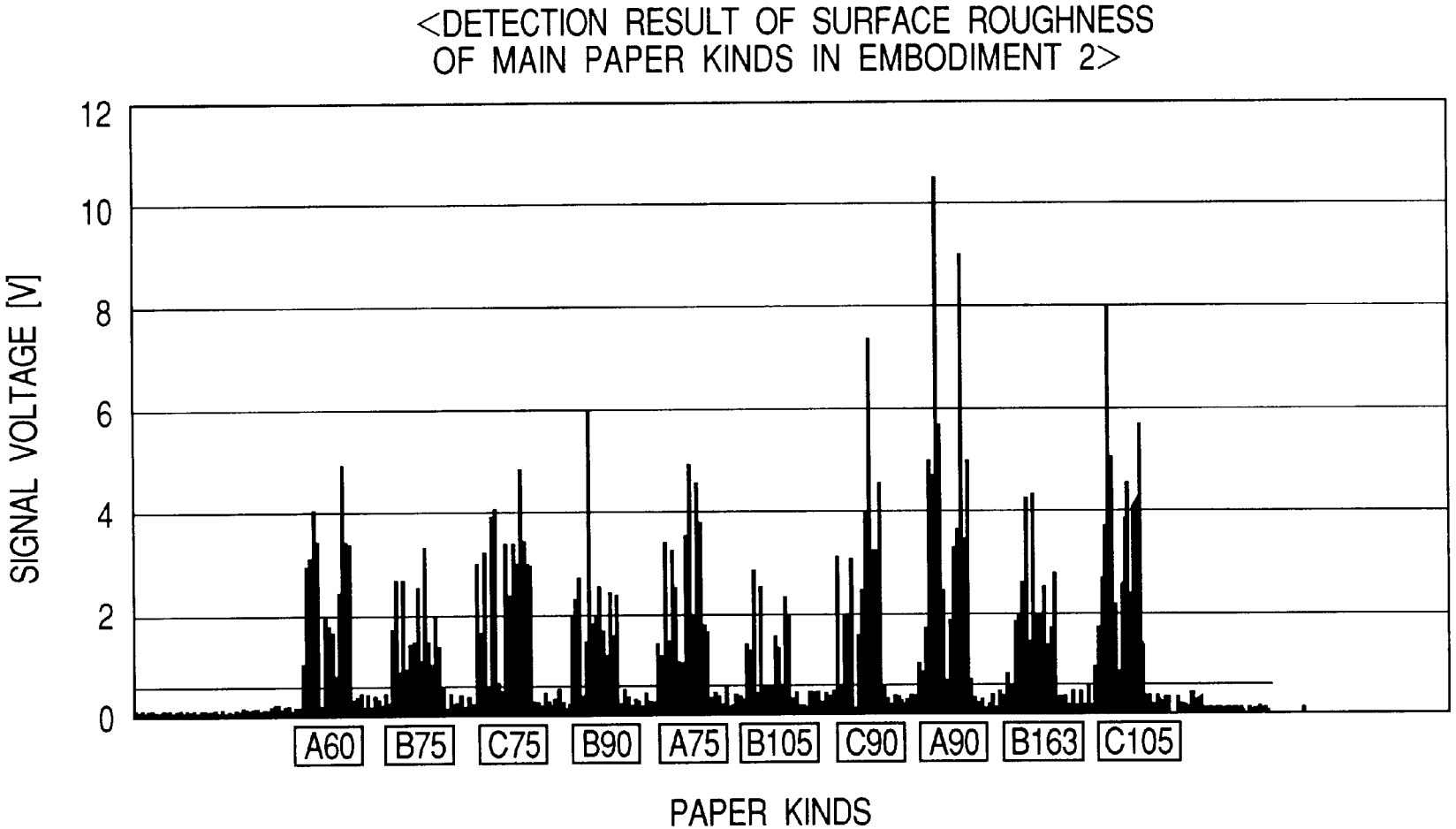
FIG. 9C is a comparison graph of the results of surface roughness detection.

The graph of FIG. 9C shows the result of the evaluation made with sheets of paper of the same smoothness as that of FIG. 7A supplied in the same order by the use of the construction of the present embodiment, and except a noise component of a high level locally irregularly occurring, as compared with the graph of the example of the conventional art, the signal intensity corresponding to the smoothness of paper and the difference in the density thereof are apparently actualized, and for paper of high smoothness, a signal of high intensity and high density tends to be obtained, and for paper of low smoothness, a signal of low intensity and low density tends to be obtained, and it has been found that by applying electrical signal processing (not shown) for suppressing the influence of the noise component, and emphasizing these differences, it becomes possible to give a discrimination signal having a sufficiently discriminable level difference to a CPU (not shown) used for the various kinds of control of the apparatus.

It has been confirmed that by using the construction of the present embodiment, discriminating performance similar to that of Embodiment 1 is obtained, and in the construction of the present embodiment, the tip end portion itself of the sensor abuts at an angle in a forward direction relative to the direction of movement of the recording material and therefore, even if the leading edge portion of the paper has come to the detecting position of the sensor 22, it is possible for the tip end portion of the sensor to scan while abutting against the scanning surface with the aforedescribed pressure force, and even if in fact, thin paper having a paper thickness of 65 $\mu$m was supplied, such evils as the deformation and bad conveyance of the leading edge of the paper did not occur, and there was no problem even if the pressure force was strengthened to 30 gram-weight.

Also, from this feature, it is also possible to use the present sensor 22 as a paper leading edge detecting sensor for detecting the leading edge passage timing of paper being conveyed. That is, the present sensor 22 standing by at a sensor abutting position, in its stationary state, is outputting a noise signal of a feeble voltage level due to the slight vibration noise or electrical noise of the entire apparatus, but at the moment when the leading edge of paper conveyed thereto has collided against the present sensor 22, a pulse-like signal extraordinarily greater than a noise level is generated in the sensor 22 and therefore, it is possible to judge that the leading edge of the paper has come to the sensor abutting position at the moment when the extraordinarily great pulse-like signal has been generated at first from a state in which a signal of a noise level is being outputted for at least the inter-paper time during which paper and paper pass, and by processing this moment as a paper leading edge detection signal, it is possible to determine the operating time of each image forming element, and this makes it unnecessary to use an optical type sensor like a photo-interrupter heretofore used as a paper leading edge detecting sensor, and it becomes possible to realize the two functions of detecting the quality of paper and the leading edge of paper at a low cost by the signal present sensor.

<Embodiment 3>

Figure 10A:
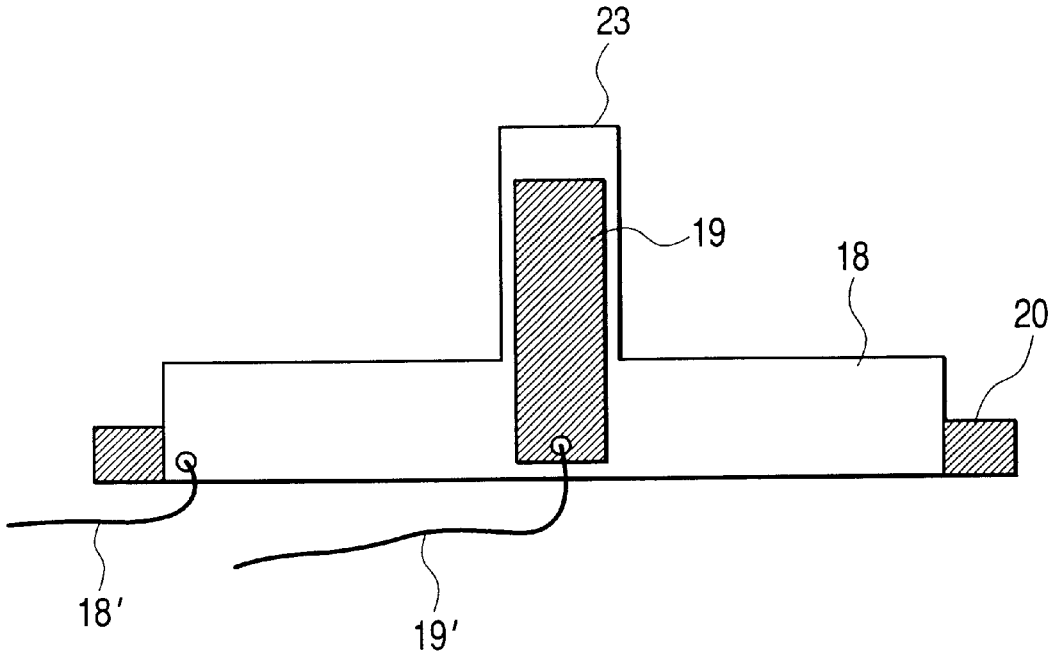
FIG. 10A is a top plan view of a surface roughness detecting device according to Embodiment 3 of the present invention.
Figure 10B:
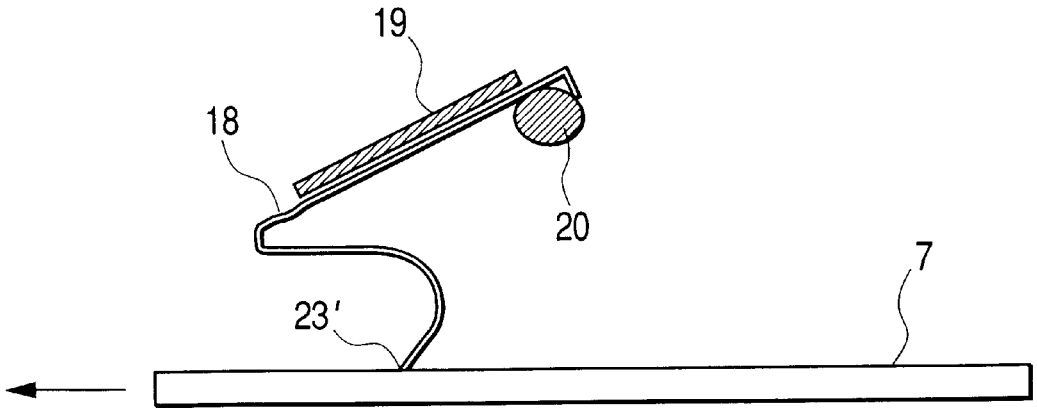
FIG. 10B is a cross-sectional view of the surface roughness detecting device.
Figure 11A:
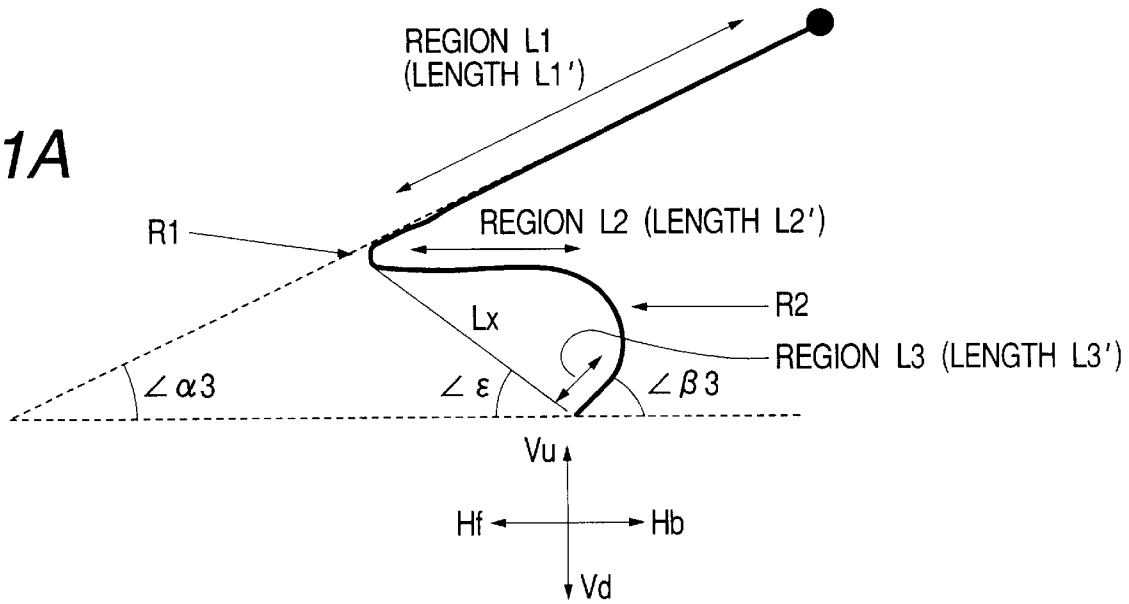
FIG. 11A is a cross-sectional view of the probe of the surface roughness detecting device according to Embodiment 3 of the present invention.
Figure 11B:
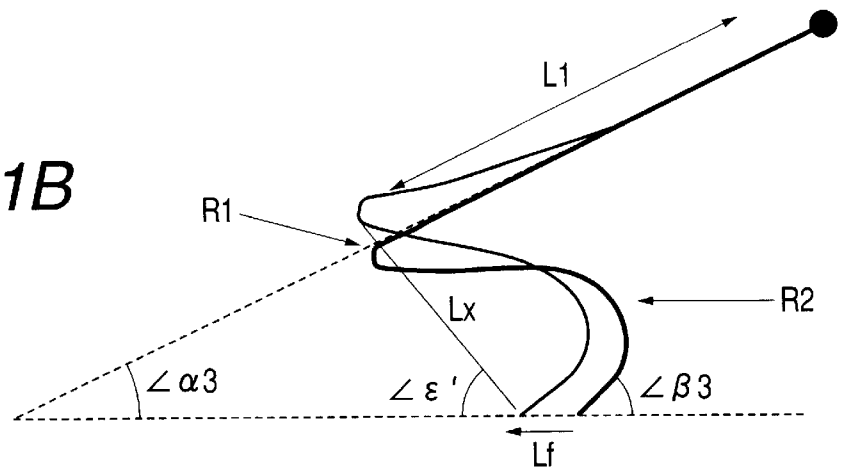
FIG. 11B is an illustration of the operation during the scanning by the probe.
Figure 12A:
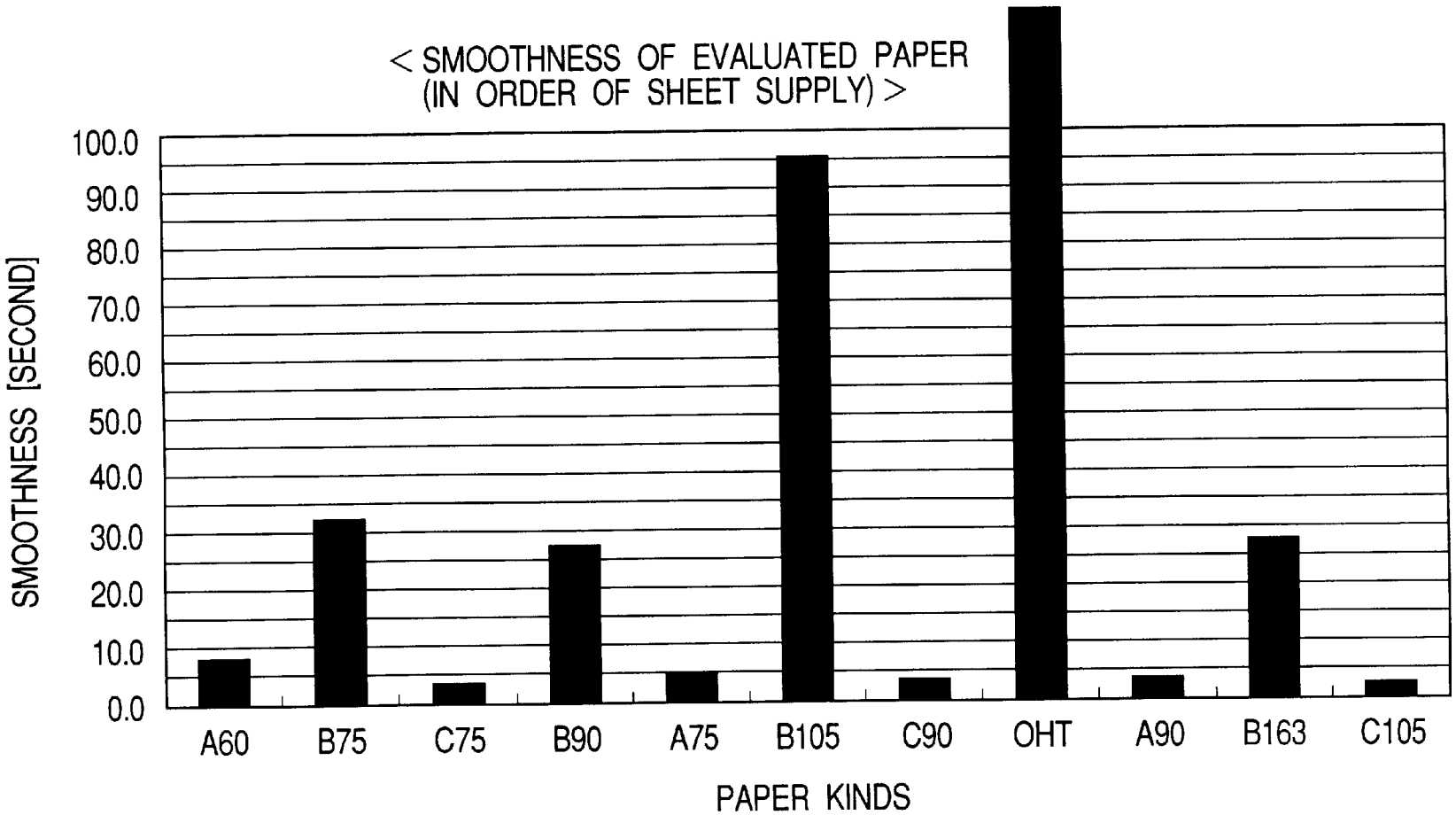
FIG. 12A is a comparison graph of the smoothness of evaluated sheets used in Embodiment 3 of the present invention.
Figure 12B:
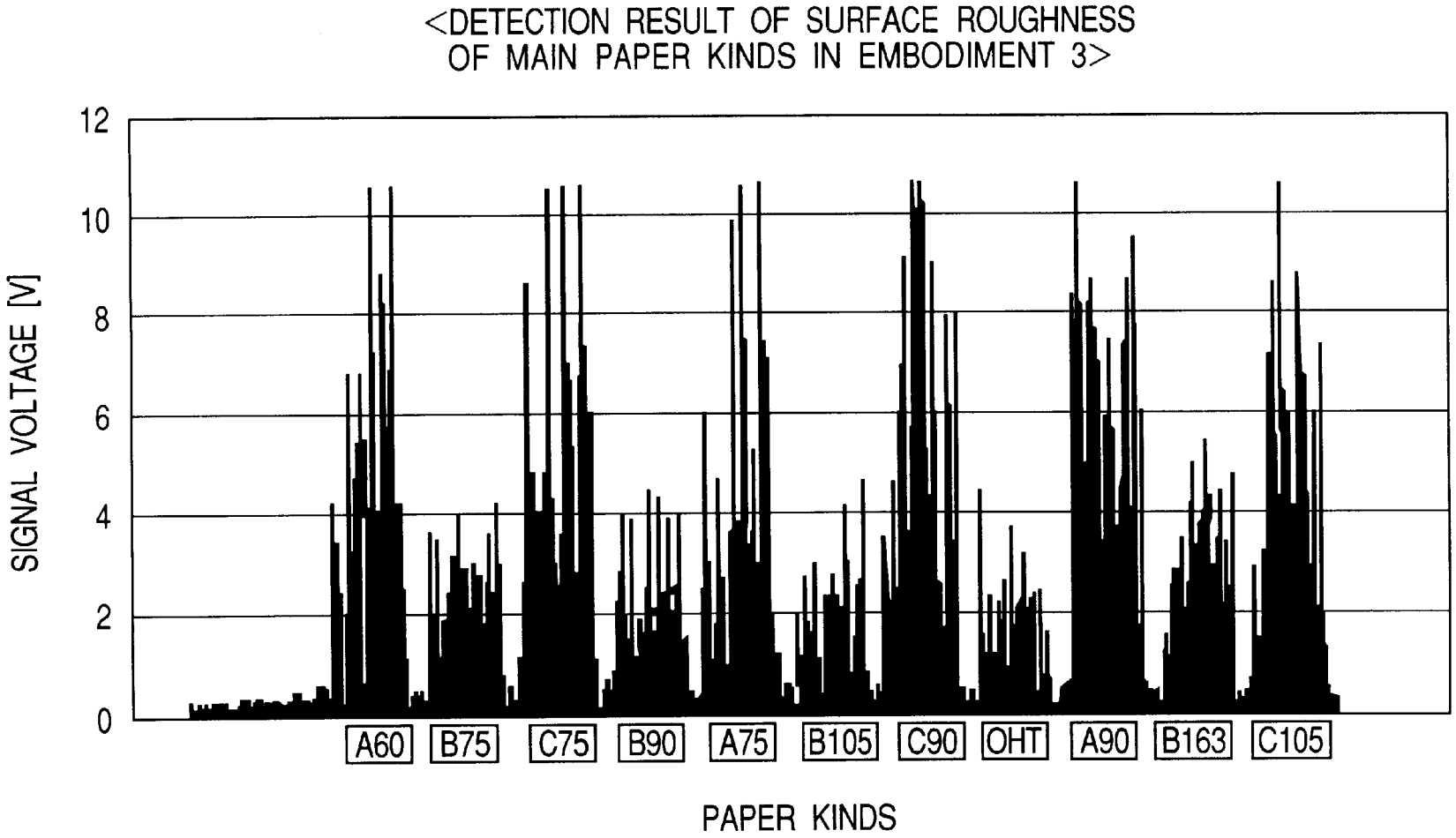
FIG. 12B is a comparison graph of the results of surface roughness detection.

FIGS. 10A and 10B, FIGS. 11A and 11B, and FIGS. 12A and 12B show Embodiment 3 of the present invention, FIG. 10A being a top plan view of a paper surface roughness detecting device, FIG. 10B being a cross-sectional view of the paper surface roughness detecting device, FIG. 11A being a cross-sectional view of the probe of the paper surface roughness detecting device, FIG. 11B being a cross-sectional view for illustrating the operation during the probe scanning of the paper surface roughness detecting device, FIG. 12A being a smoothness comparison graph of paper used in the present embodiment, and FIG. 12B being a surface roughness detection comparison graph.

In FIG. 10A, the same elements as those shown in FIG. 1B are given the same reference numerals, and the present embodiment, as is apparent from FIG. 10B, is characterized in that unlike the J-shaped cross-sectional shape of Embodiments 1 and 2, use is made of an S-shaped cross section sensor 23 comprised of two bent curved portions, and having a fixed end disposed on the downstream side with respect to the scanning direction (the upstream side with respect to the direction of movement of the recording material), and having a tip end abutting portion disposed on the upstream side, and by this setting, the entire sensor 23 has an S-shaped abutting tip end 23' adapted to abut against the paper while it is set in a forward direction relative to the direction of movement of the recording material and the tip end portion of the sensor also abuts against the paper at such an angle in the forward direction as will not hinder the entry of the paper being conveyed, and while the upstream side corner of the tip end portion eats into the surface of the paper in a direction opposite to the direction of movement of the recording material.

As regards the details of each portion, as shown in the cross-sectional typical view of FIG. 11A, a piezoelectric element forming area is defined as L1, the radius of curvature of a first bent portion which is the first bent portion as viewed from the fixed end side is defined as R1, the area from the first bent portion to the tip end abutting portion of the sensor is defined as L2, the length (L2') of L2 is set so as to be shorter than the length (L1') of L1, the radius of curvature of a second bent portion provided forwardly thereof is defined as R2, the area from the second bent portion to the tip end abutting portion of the sensor is defined as L3, and the length (L3') of L3 is set so as to be shorter than the length of L2. Specifically, L1' is 13.5 mm, L2' is 5.0 mm, L3' is 1.5 mm, the radius of curvature R1 is 0.5 mm and the central angle thereof is 160°, the radius of curvature R2 is 2.0 mm and the central angle thereof is 120°, the set angle difference of L1 with respect to the scanning plane is $\angle\alpha 3=30°$, and the set angle of L3 is $\angle\beta 3=60°$.

Although the portions L2 and L3 need not always be straight, the angle with respect to the scanning plane when the portion L2 is straight need be within the practical range of less than 30° in the plus direction from the horizontal plane with the end portion nearer to R1 as the center and less than −60° in the minus direction, according to the present construction, and in the present embodiment, it is set substantially horizontally. On the other hand, as regards the portion L3, if the abutting angle is kept, the end portion of the arc R2 may be intactly used as the tip end.

Also, regarding the abutting pressure, a coil winding spring is provided so that a pressure force may act in the tangential direction of a circumference rotating about a rotary shaft, whereby a pressure force of 20 gram-weight is applied to the tip end portion of the sensor.

As is apparent from FIG. 11A, an angle $\angle\epsilon$ is formed between a straight line Lx linking the tip end portion R1 of the sensor set in the above-described construction and the abutting tip end portion of the sensor together and the downstream side scanning plane and in the present invention, unless so strong a force that the entire sensor escapes in the rotational direction about the rotary shaft acts on the tip end portion of the sensor, R1 imaginarily acts as a fixed end and therefore, as long as the angle $\angle\epsilon$ is within a range which satisfies $\angle\epsilon<90°$, a force urging the upstream side corner of the tip end against the surface of the paper against the direction of movement of the recording material acts on the tip end portion of the sensor, as in the case of the counter-disposed J-shaped sensor of Embodiment 2, and the sensor scans while causing its tip end to eat into the surface of the paper, whereby the delicate difference in paper surfaceness is made detectable by relatively light abutting pressure.

Particularly, in the present sensor, due to the structural feature thereof, from a microscopic viewpoint, the curved portion imaginarily acts as a fulcrum and therefore, there is such mechanical amplifying action that during the time when minute displacement occurring to the shorter side of the tip end portion of the sensor is transmitted to the portion L1 through the two curved portions, it is transmitted as greater displacement to the longer side of the portion L1 by the action of levers, while on the other hand, from a macroscopic viewpoint, when as shown in FIG. 11B, as in Embodiments 1 and 2, the tip end portion of the sensor is deformed toward the downstream side with respect to the direction of movement of the recording material by a frictional force working between it and the paper, $\angle\epsilon$ rises to a greater angle $\angle\epsilon'$ and at this time, the structural portion lower than R1 is constituted by shorter sides and curved structure and is higher in rigidity than the longer sides of the portion L1 and therefore, can efficiently convert the force acting on the tip end portion into a force raising the tip end portion R1 without its force being absorbed by unnecessary deformation (in drawing the figure, the greater is made the length of the portion lower than R1, the greater can be made the deformation of the portion L1, but as long as use is made of the same member having a uniform thickness, if this length is made excessively great, rigidity is reduced and deformation becomes liable to occur, and the displacement in the scanning direction and vibration intensity are absorbed by this portion and the discrimination ability is reduced and therefore, the above-described setting is preferable from the viewpoint of space efficiency as well), whereby it is possible to warp-deform the portion L1 and induce strong distortion in the interior of the piezoelectric element and generate a great signal.

Even for macroscopical displacement, the present sensor, as compared with Embodiment 1, is easier to deform toward the downstream side because its tip end itself abuts in the forward direction, and its fixed end is not on the downstream side as in Embodiment 2 and therefore, the vibration range of the entire sensor toward the downstream side becomes wider and thus, greater deformation is possible than in the case of Embodiments 1 and 2, and by this characteristic, it becomes possible to produce a greater signal for paper having greater frictional resistance and therefore, as a result, the discriminating performance is further improved.

By the above-described structural feature of the present sensor, sheets of paper differing in smoothness as shown in FIG. 12A were alternately supplied and the discrimination signal thereof was evaluated with a result that there was obtained a signal waveform as shown in FIG. 12B, and it has been found that as compared with the results of Embodiments 1 and 2, the entire signal level is high and also, the signal level difference between rough paper and smooth paper is greatly enlarged and the discriminating performance for the surface of paper is improved markedly.

Figure 13A:
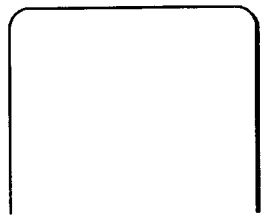
FIGS. 13A, 13B, 13C, 13D and 13E are top plan views of the tip ends of the probes of the surface roughness detecting devices.

In each of the above-described embodiments, use is made of a metal plate of such a shape that the shape of the tip end portion of the sensor in the horizontal direction as it is seen from its upper surface is flat in a direction in which the tip end is orthogonal to the scanning direction and only the right and left corners are rounded, as shown in FIG. 13A.

The detecting method by the sensor of the present invention mechanically converts the difference in surface frictional resistance averaged in the abutting surface which is the surface of an object to be measured into a vibration intensity difference to thereby discriminate, and if use is made of a probe having a needle-like sharp tip end as used in the conventional surface roughness measuring device, conversely the tip end portion thereof becomes liable to be hooked on the paper fiber of the surface of even smooth paper and may injure the surface of the object to be measured and at the same time, signal intensity unnecessarily increases and the discrimination from the signal of rough paper becomes difficult and the discriminating performance is reduced. This tendency becomes greater as the scanning speed becomes higher and therefore, conversely the sensor of the present invention has the advantage that it can discriminate even at such high-speed scanning as cannot be detected in the conventional method. Therefore, even if it becomes necessary to change the shape of the tip end of the abutting portion in order to adjust the frictional resistance in the present method, sharp corners should not be provided in the tip end portion, and if provided, it is preferable that the angle thereof be an obtuse angle.

Figure 13B:
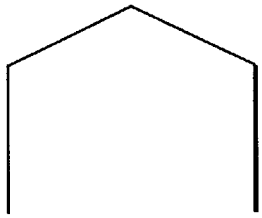
Figure 13C:
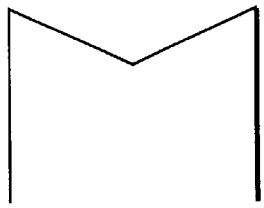
Figure 13D:
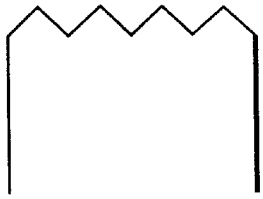

The discrimination signal when the wedge shape of an angle of 120° as shown in FIG. 13B was rounded at its tip end did not much differ from that in the case of the above-described flat tip end shape, but yet when corners of 60° were provided as shown in FIG. 13C, the signal for smooth paper was unnecessarily increased and the discriminability was greatly reduced, and even when as shown in FIG. 13D, the number of acute corners was increased to thereby disperse the load applied to a corner, improvement was difficult.

Figure 13E:
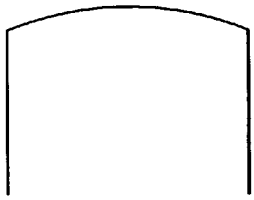

On the other hand, when the fixing accuracy of the tip end portion of the sensor is insufficient or may fluctuate during the use thereof and the maintenance of the orthogonality thereof to the scanning direction may be uncertain, the tip end portion may be inclined to right and left and the load may concentrate in the corner sides to thereby reduce the discriminability and therefore, a method as shown in FIG. 13E wherein the entire tip end is worked into a smooth arcuate shape in advance is advantageous.

<Embodiment 4>

Figure 14A:
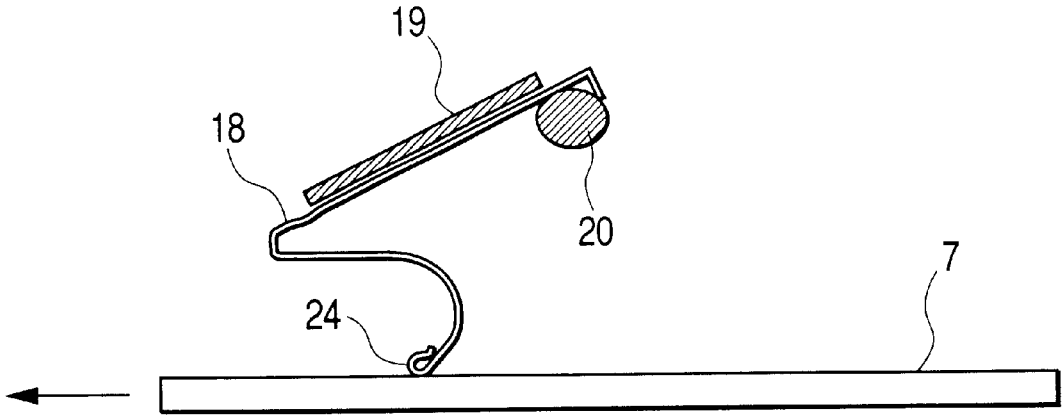
FIG. 14A is a cross-sectional view of a bent tip end type surface roughness detecting device according to Embodiment 4 of the present invention.
Figure 14B:
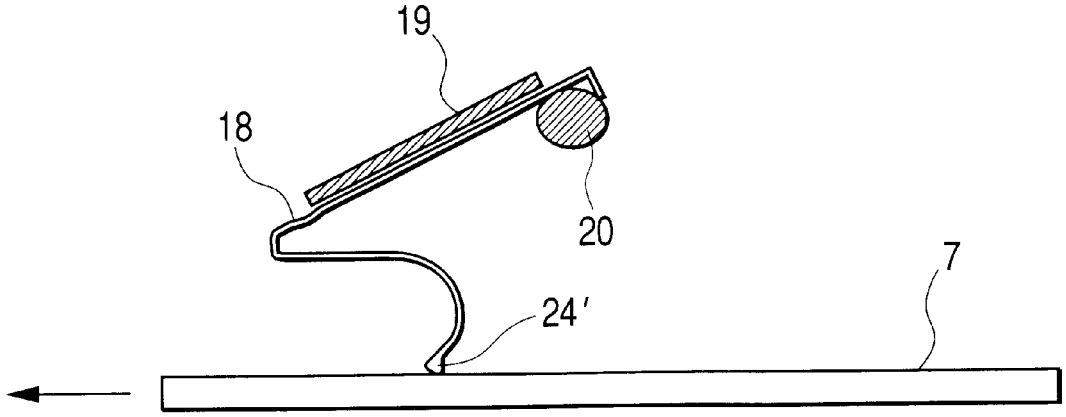
FIG. 14B is a cross-sectional view of an embossed tip end type surface roughness detecting device.

FIGS. 14A and 14B are cross-sectional views of a paper surface roughness detecting device according to Embodiment 4 of the present invention, and in these figures, the same elements as those shown in FIG. 10B are given the same reference numerals.

In the present embodiment, in FIG. 14A, use is made of tip end structure such as a bent curved surface tip end 24 in which the tip end portion of the sensor metal plate is bent, and in FIG. 14B, use is made of tip end structure subjected to mechanical machining such as an embossed curved surface tip end 24' in which the tip end portion of the sensor metal plate is embossed and partially protruded to the surface side. By such machining, the surface roughness of the metal surface is intactly utilized and the formation of the abutting surface becomes possible and it is also possible to form it at the same time during the press machining of the entire metal plate and therefore, it is possible to save the trouble to polish the tip end abutting portion to necessary roughness by post-machining during the making of the metal plate.

Particularly, in FIG. 14A, if minute projections such as burrs are present on the abutting surface side of the right and left cross-sectional portions of the bent metal plate, the possibility of the discrimination ability of smooth paper being reduced is low, but in FIG. 14B, these concerns can be eliminated by machining the embossed curved surface to such a size that it protrudes more greatly from the abutting surface than any minute projections such as burrs which can exist at right and left sides. In this case, however, if the amount of this embossed protrusion is too great, the surface of the paper is frictionally contacted by a discontinuous surface and therefore, there is the danger of the leading edge portion being deformed or the conveyability of the paper being deteriorated, and such a machining method as will restrict the amount of protrusion thereof to a proper range or protrude it while leaving a continuous surface is necessary and at the same time, it is necessary to suppress the irregularity of the amount of protrusion or the protruding position highly accurately.

In the present construction, it becomes possible to prevent the danger that minute projections such as burrs on the section of the metal hook the fiber of the paper to thereby produce an unnecessary signal for smooth paper, but if the radius of curvature thereof relative to the scanning direction is too great, the discrimination ability of rough paper will be reduced and therefore, moderate sharpness is also necessary, and it is preferable with the limitations in the actual machining technique taken into account that the radius of curvature thereof be of the order of 0.05–0.3 mm.

The method of making the curved metal surface in the present embodiment not requiring polishing abut as described above is not limited to the above-described two examples, but of course, other shapes and machining methods such as three-dimensionally machining the tip end portion would also occur to mind, and basically all are the same in utilizing a curved metal surface, and any method inexpensive in manufacturing cost and high in machining accuracy can be selected from among them.

<Embodiment 5>

Figure 15:
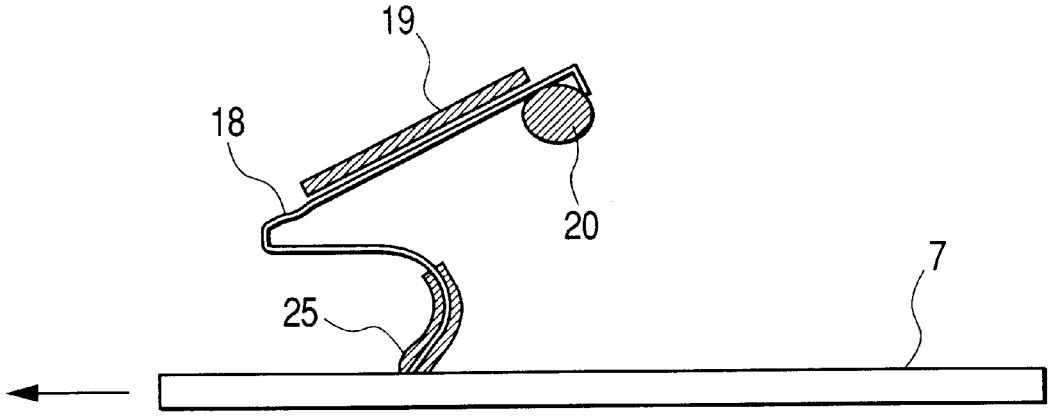
FIG. 15 is a cross-sectional view of a surface roughness detecting device according to Embodiment 5 of the present invention.

FIG. 15 is a cross-sectional view of a paper surface roughness detecting device according to Embodiment 5 of the present invention, and in this figure, the same elements as those shown in FIG. 10B are given the same reference numerals.

In the present embodiment, use is made of a surface covered tip end 25 covered with a material having desired surface roughness or durability, instead of subjecting the tip end portion of the metal plate of the sensor to the polishing process or the machining like that of the aforedescribed Embodiment 4.

In the present embodiment, the sensor has a polyimide tape stuck on its tip end portion, whereby without polishing the tip end portion of the metal plate, it is possible to improve the discrimination ability of smooth paper by the use of the surface roughness of the tape. As a method of covering this tip end portion, besides sticking a tape as in the present embodiment, use may be made of other methods such as coating, dipping, vapor deposition or plating, and as the material for covering, a necessary material can be selected from among other resin materials such as fluorine resin or high-density polymer resin, and inorganic materials such as metals, ceramics and DLC (diamond-like carbon) in conformity with the characteristic and strength to be given to the tip end portion. However, when use is made of an insulative material such as a resin material which is readily chargeable, there is the danger of unnecessarily charging the paper side to thereby cause bad transfer at the transferring step later when the intensity of the frictional contact between the sensor and the surface of the paper becomes strong due to the construction of the apparatus, and therefore it is necessary to apply a charging preventing process as required.

<Embodiment 6>

Figure 16:
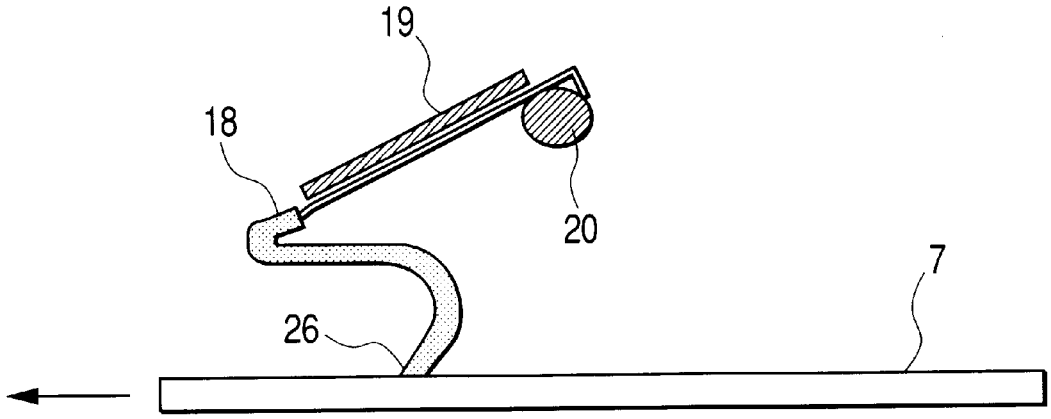
FIG. 16 is a cross-sectional view of a surface roughness detecting device according to Embodiment 6 of the present invention.

FIG. 16 is a cross-sectional view of a paper surface roughness detecting device according to Embodiment 6 of the present invention, and in this figure, the same elements as those shown in FIG. 10B are given the same reference numerals.

In the present embodiment, use is made of a discrete member type tip end 26 in which the tip end portion of the metal plate of a sensor is constituted by the metal plate of a piezoelectric element forming portion and a discrete member. In the present embodiment, a tip end resin probe formed of POM (polyacetal) is used and adhesively secured to the flat metal plate of the piezoelectric element forming portion, and during the formation of this resin, a necessary three-dimensional shape and surface roughness are given to the tip end portion of the probe.

By making a sensor with the construction of the present embodiment, it becomes possible to easily give and select a shape and surface roughness and a material necessary for the tip end portion of the sensor and also, when as in the aforedescribed embodiments, the metal plate is machined into a three-dimensional shape such as a J-shape or an S-shape and then the piezoelectric element forming portion is to be formed, a machining stand exclusively for use therefor is necessary, but in the present embodiment, it becomes possible to discretely form the piezoelectric element forming portion on the surface of the flat metal plate and therefore, the mass productivity of the piezoelectric element forming step can be improved.

As the material of the probe in the present embodiment, use can of course be made of a metallic material besides a resin material or ceramics higher in wear resistance, and it is also possible to collectively smoothly polish the end surfaces of a plurality of metal plates machined into a probe shape by the tumbling process or chemical treatment, and thereafter make them integral with a piezoelectric element forming metal plate by adhesive securing, pressure securing or welding.

<Embodiment 7>

Figure 17:
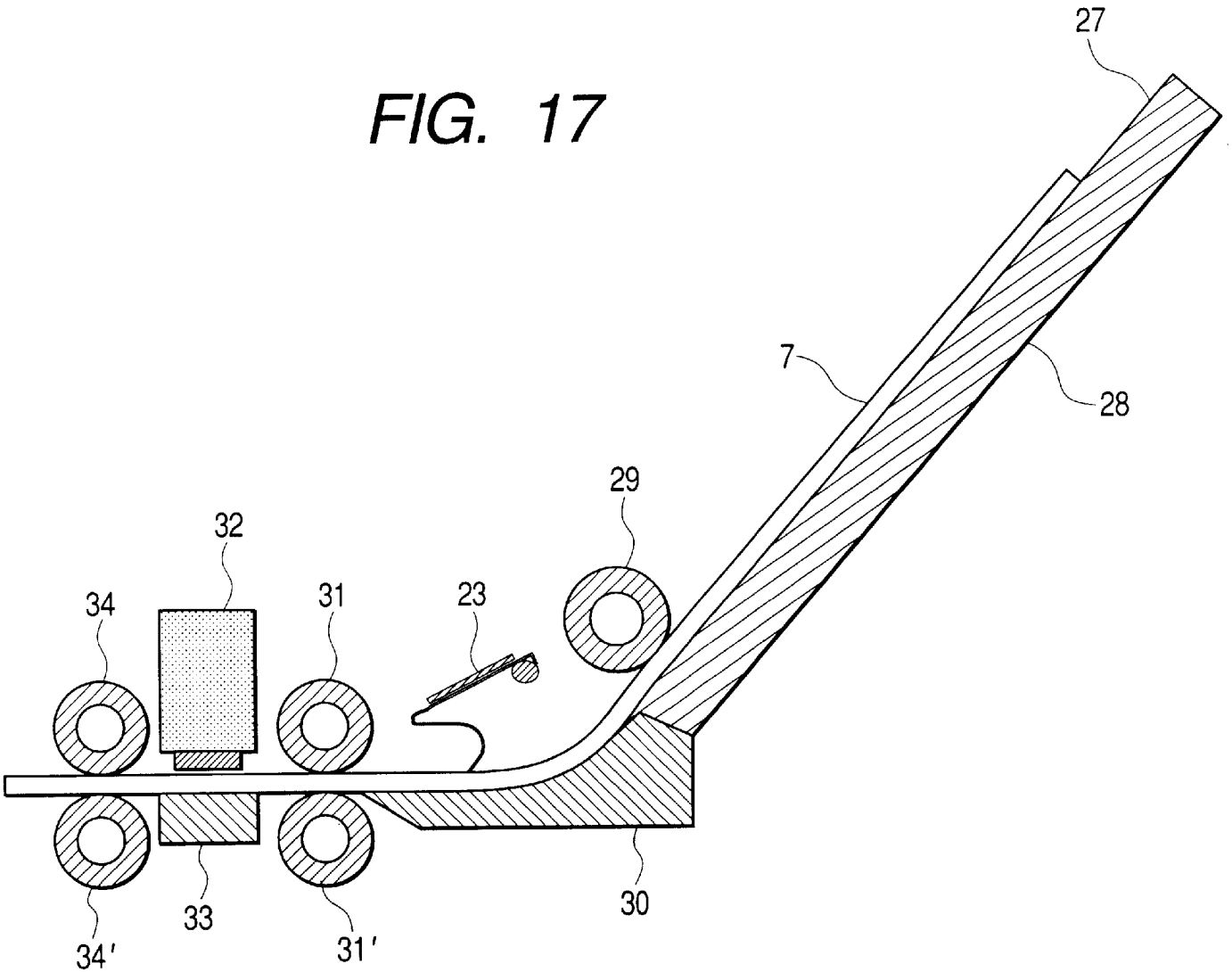
FIG. 17 is a cross-sectional view of an ink jet printer with a paper kind detecting device according to Embodiment 7 of the present invention.

FIG. 17 is a cross-sectional view of an ink jet type image forming apparatus according to Embodiment 7 of the present invention.

In the present embodiment, an ink jet printer 27 with the paper kind detecting function is constructed by using an S-shaped cross section sensor 23 as the paper surface roughness detecting sensor according to the present invention. The present apparatus, in this cross-sectional structure, is comprised of a paper feed tray 28, a paper feed roller 29 for ink jet, a paper guide 30, a pinch roller 31, a conveying roller 31' opposed to the pinch roller, a recording head 32, a platen 33, a paper discharge roller 34, a spur 34', etc., and is usually designed such that after a printing signal has been received, paper on the paper feed tray 28 is conveyed to the pinch roller 31 portion by the paper feed roller 29, and the paper is conveyed to the platen 33 portion by a necessary amount of feed by the operation of the pinch roller 31 portion, and an image is formed on an area of the paper corresponding to the amount of feed by the recording head 32, whereafter the paper is sequentially fed by the operation of the pinch roller 31 portion, and the paper after the recording is nipped and conveyed by the discharge roller portion, and after the entire image formation is completed, the paper is finally discharged.

In the present embodiment, the present sensor 23 is disposed at a location opposed to the paper guide 30 portion between the paper feed roller 29 portion and the pinch roller 31 portion, and scans the surface of the paper during the time at the initial stage of the printing operation when the leading edge portion of the paper is conveyed from the paper feeding portion to the pinch roller 31 portion to thereby detect the surface roughness or frictional resistance of the paper and discriminate the kind of the paper, and for example, for smooth paper, the amount of protrusion of ink is suppressed to thereby form an image, whereby the saving of the ink can be accomplished and the outflow and oozing of the ink to any unnecessary portion can be suppressed, and conversely for paper having a rough surface, with the soaking of the ink into the lower layer portion of the paper taken into account, control is changed over so as to increase the amount of protrusion of the ink, whereby it becomes possible to prevent such a problem as a reduction in density from arising and thus, it is possible to change over the amount of control of the image forming conditions including the amount of protrusion of the ink.

As a sensor for the use of this kind, a device using an optical type sensor to detect the glossy difference or the like of the surface of paper and effect the discrimination of the kind of the paper has already developed in some kinds of machines, but the optical type sensor requires a number of component parts such as an optical system including a light source, a lens, a filter, etc. and photoelectric conversion elements such as a photodiode and a CCD, and high accuracy is also required of the accuracy of each part and high mounting accuracy is necessary during the assembly of the parts, and this leads to the disadvantages that the cost is liable to become high and further that the performance is liable to be affected by the stains of the optical system.

In contrast, the sensor of the present invention can have its metal plate, piezoelectric element, etc. inexpensively constituted by widely used universal members, and the surface of the detecting portion of the sensor is automatically cleaned by the surface of paper each time paper is supplied, and even if dust or the like adheres to the other portions, the performance is basically not affected thereby, and if it is affected at all, dust or the like will be shaken off by generated vibration and therefore, there is not the necessity of fearing the deterioration of performance by stains, and this also means excellence in reliability.

Figure 18:
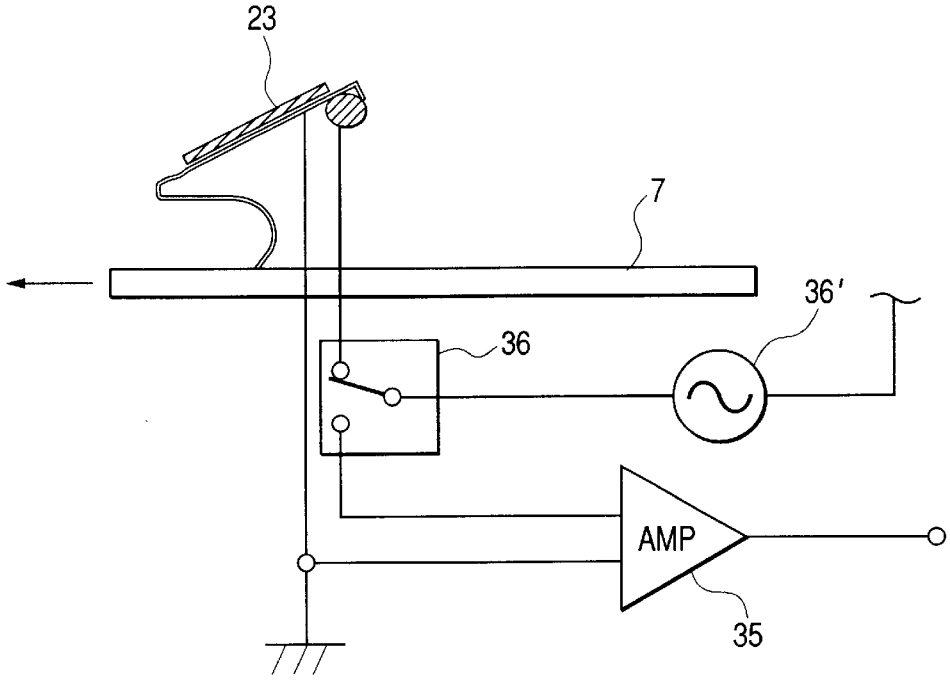
FIG. 18 shows the construction of cleaning means for the surface roughness detecting device.

Also, in a case where the adherence strength of stains is so great that the stains cannot be shaken off by the vibration level during normal detection, as shown in FIG. 18, a changeover switch 36 and AC voltage applying means 36' are provided in a signal wiring portion connected to the amplification circuit 35 of the read-out circuit of the sensor 23, and the connection is changed over to the AC voltage applying means during any non-detection period, whereby it is also possible to adjust so that the piezoelectric element forming portion can be forcibly vibrated at any intensity and frequency to thereby efficiently shake off the dust, and in the present sensor 23, a voltage of an amplitude 5V is applied at a frequency of 500 Hz in the vicinity of the resonance frequency of this sensor 23 to thereby efficiently enable the sensor 23 to be forcibly vibrated by small electric power, and the stains adhering to the surface of the sensor 23 can be efficiently removed.

<Embodiment 8>

Figure 19:
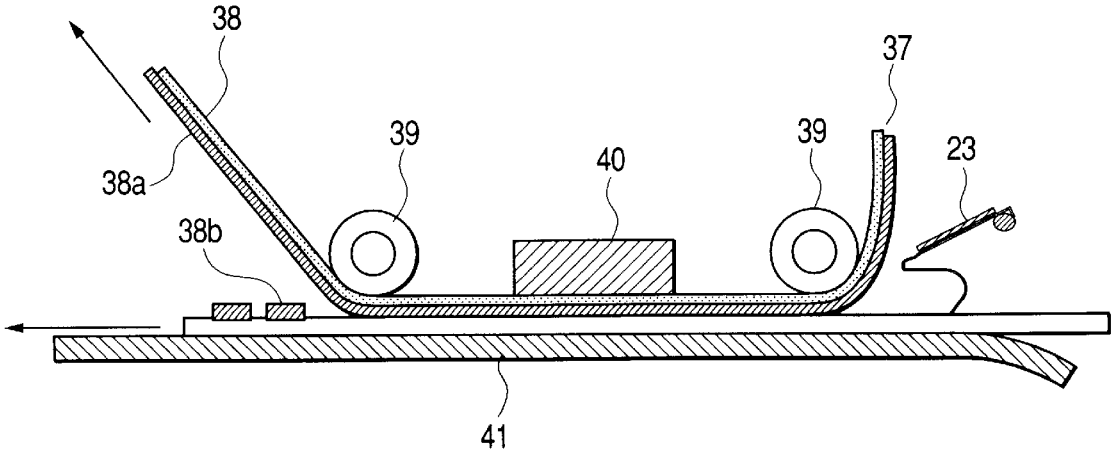
FIG. 19 is a cross-sectional view of a thermal head printer according to Embodiment 8 of the present invention.

FIG. 19 is a cross-sectional view of a thermal head type image forming apparatus according to Embodiment 8 of the present invention.

In the present embodiment, a thermal head printer 37 with the paper kind detecting function is constructed by using a sensor 23 as the paper surface roughness detecting sensor according to the present invention. The thermal head type image forming apparatus according to the present embodiment is comprised of an ink ribbon 38, a pair of ink ribbon conveying rollers 39, a thermal head 40, a head opposing plate and paper conveying guide 41, etc., and is usually designed such that after a printing signal has been received, paper is conveyed to the nip portion between the head opposing plate and paper conveying guide 41 and the ink ribbon conveying roller 39 on the paper feeding side by a paper feed roller and a paper conveying roller (not shown), and is nipped between the ink ribbon 38 and the guide 41, and thereafter is conveyed to the head portion with the ink ribbon 38 while being in close contact with the ink ribbon 38, a necessary electric power is supplied to the head portion in conformity with the printing signal to thereby heat and fuse an ink layer 38*a* on the ink ribbon 38 and thermally transfer the ink to the surface of the paper and thereby form an ink image 38*b* on the paper, whereafter the paper is sequentially fed out by the operation of the conveying roller portion.

In the present embodiment, the present sensor 23 is disposed at a location opposed to the guide 41 portion short of at least the nip portion between the guide 41 portion and the ink ribbon conveying roller 39 on the paper feeding side, and scans the surface of the paper during the time at the initial stage of the printing operation when the leading edge of the paper is conveyed from the paper feeding portion to the above-mentioned nip portion to thereby detect the surface roughness or frictional resistance of the paper and discriminate the kind of the paper, and for example, for smooth paper, the conduction of heat becomes good and therefore thermal transfer can be effected with low electric power and thus, control is changed over so as to mitigate the electric power supplied to the ink head, and conversely in the case of paper having a rough surface, the conductivity of heat is reduced and moreover, to sufficiently transfer the ink to the rough surface, it is necessary to reduce the viscosity of the ink and therefore, it becomes possible to change over the control so as to sufficiently reduce the viscosity of the ink by higher electric power and thus, it becomes possible to change over the amount of control of the electric power suited for each kind of paper.

Thus, according to the above-described embodiment, when a vibrating portion in the scanning direction capable of vibrating back and forth in the scanning direction provided at the tip end portion of a probe having a piezoelectric element abuts against and scans the surface of an object to be measured having any surface roughness, it is displaced and vibrates in a vertical direction in conformity with the unevenness of the surface of the object to be measured and besides, in conformity with the frictional resistance difference of the surface of the object to be measured, a difference occurs to the amount of displacement back and forth in the scanning direction in which the tip end portion thereof vibrates, and an amplitude and vibration intensity and a difference in frequency characteristic occurring on the basis of the displacement are efficiently transmitted as an amplitude and vibration intensity and a difference in frequency characteristic in the electromotive force generating direction of a piezoelectric element forming portion by a mechanical construction, and the intensity of the vibration is converted into the intensity of an electrical signal by the piezoelectric element forming portion and detected, and by that intensity and the result of the frequency characteristic, it becomes possible to discriminate the frictional resistance difference of the surface of the object to be measured and the surface roughness and the surface material difference which are the factors of the frictional resistance difference, and the microscopical characteristic difference of the surface of the object to be measured is mechanically amplified and converted into the macroscopical kinetic energy of the tip end portion of the probe and is detected and therefore, as compared with the conventional method of simply detecting in conformity with the unevenness of the surface, S/N is greatly improved and the minute concavo-convexity difference of the surface of the object to be measured can be discriminated simply and at a high speed.

Also, as a specific construction of the vibrating portion in the scanning direction, at least one bent portion is provided on the cross-sectional shape of the probe as it is seen from a cross section perpendicular to the scanning surface and parallel to the scanning direction, and the tip end of the probe is made partially vibratable back and forth in the scanning direction about the bent portion, and an angle and a pressure force are set so that a force with which the tip end bites into the surface of the object to be measured may act on the tip end portion of the probe against the direction of movement of the recording material to such an extent as will not hinder scanning, and the tip end of the probe is made partially vibratable back and forth in the scanning direction about the bent portion, and besides the vertical vibration by the collision thereof against the unevenness of the surface of the recording material, there comes to be induced vibration back and forth in the scanning direction creating a greater intensity difference in conformity with a frictional resistance difference attributable to the concavo-convexity difference of the surface of the recording material. Thus, the bent tip end portion of the probe is pushed and deformed toward the upstream side in the scanning direction by a frictional force acting between it and the surface of the recording material and also, by this deformation, a force of restriction is induced in the probe and a force of restitution conforming to the material and amount of deformation of the probe is created, and at a point of time whereat it exceeds the frictional force, the tip end of the probe once passes its original position by inertia and then returns to its original position, whereafter the probe repeats this and vibrates, and this vibration intensity difference in the forward and backward direction is created in proportion to the contact width and pressure force between the surface of the recording material and the tip end of the probe and therefore, rather than vertically vibrated by the microscopical unevenness of the surface of the recording material, a macroscopical force can be a vibration source, and this vibration created in the bent tip end portion acts as a force for bending the piezoelectric element forming portion having this tip end portion held down by a pressure force and having the other end thereof fixed because by the rigidity of the tip end portions being sufficiently secured, the action for vertically vibrating the central portion of the bend works with the forward and backward displacement in the scanning direction, and at that time, there is produced a voltage signal of strength conforming to the intensity difference of distortion and shock or the like created in the element, and this signal becomes detectable as a discrimination signal.

Further, making the length from the bent portion to the tip end of the probe shorter than the length of the piezoelectric element forming portion from the bent portion to the fixed end thereof contributes to securing the rigidity of the tip end portion when the entire probe is formed of the same material and also, the bent portion acts as a fulcrum, and by the principle of the lever, the vibration of a minute amplitude of the tip end of the probe can also impart the action of it being mechanically amplified into vibration of a greater amplitude in the piezoelectric element forming portion, and S/N is further improved.

Also, since the angle and pressure force are set so that there may act a force with which the bent tip end of the probe eats into the surface of the object to be measured against the direction of movement of the recording material at such strength as will not hinder scanning, it never happens that as in the conventional art, the close contact property is reduced with scanning and conversely, the force of restitution of the probe acts up to its limit acting point so that the close contact strength between the tip end portion of the probe and the surface of the object to be measured may increase with scanning and therefore, even if such a great pressure force as will injure the surface of the object to be measured is not made to act on the tip end of the probe, the close contact property between the surface of the object to be measured and the tip end portion of the probe can be enhanced to thereby detect the surface frictional resistance difference with higher sensitivity and moreover, the collision strength between the convex portion of the surface of the object to be measured and the tip end of the probe can also be enhanced, and by the shock of this collision, it also becomes possible to obtain a great electromotive force instantaneously and therefore, S/N is improved.

Further, when use is made of a probe having a bent portion, the fixed end side of the probe is disposed downstream of the tip end of the probe with respect to the direction of movement of the recording material, whereby it can be caused to act so as to prevent the leading edge of a sheet member when the sheet member is scanned from riding onto the tip end of the probe to thereby cause bad scanning, and when use is made of a probe having two bent portions, the fixed end side of the probe is disposed upstream of the tip end of the probe with respect to the direction of movement of the recording material, and a piezoelectric element is formed between a first bent portion near to the fixed end side of the probe and the fixed end, and the bending direction of a second bent portion is set to a direction opposite to the bending direction of the first bent portion, and the radius of curvature of the second bent portion or the distance between the central part of this bent portion and the scanning surface is set to a value sufficiently greater than the thickness of the sheet member, whereby no hindrance occurs to the scanning of the sheet member and greater mechanical amplifying action than when the number of the bent portions is one can be made to work so that a discrimination signal of higher S/N can be obtained.

By using the above-described surface roughness discriminating device, it is possible to optimize, when the conventional heating apparatus and an image forming apparatus using a toner, ink or an ink ribbon are used, the control conditions of each apparatus in conformity with the surface characteristic of a material to be heated or a recording material.

As is apparent from the foregoing description, according to the present invention, in a surface roughness discriminating device provided with a probe adapted to abut against and scan the surface of an object to be measured to thereby discriminate the surface roughness of the surface of the object to be measured, the probe is provided with a scanning direction vibrating portion having its abutting side tip end portion repeating deformation and restitution in the scanning direction and capable of vibrating, a piezoelectric element forming portion fixed between the scanning direction vibrating portion and a fixed side end portion, and a mechanical structural portion for mechanically transmitting a deformation amount difference and a vibration intensity difference in the scanning direction and a shock intensity difference created in the scanning direction vibrating portion in conformity with the frictional resistance difference of the surface of the object to be measured during the scanning to thereby induce a deformation amount difference and a vibration intensity difference in the electromotive force generating direction of the piezoelectric element forming portion and a shock intensity difference, and design is made such that the strength of an electrical signal produced in the piezoelectric element forming portion is detected as a difference in the surface frictional resistance of the object to be measured and therefore, the paper kind selection setting work of the user is unnecessary and even if use is made of paper having any surface roughness, there is obtained the effect that good heat treatment and fixing and image formation become possible.

While the embodiments of the present invention have been described above, the present invention is not restricted to the above-described embodiments, but all modifications are possible within the technical idea of the present invention.

What is claimed is:

1. A surface discriminating device for discriminating a surface of a recording material comprising:

a probe having a fixed first end portion and a second end portion contactable with the recording material, said probe being brought into contact with the recording material to scan the recording material by relative movement between the recording material and said probe; and a piezoelectric element provided between said first end portion and said second end portion of said probe, wherein the surface of the recording material is discriminated on the basis of output from said piezoelectric element in scanning of the recording material by said probe, wherein said probe has a bent portion on a side of said second end portion, and wherein said second end portion is provided downstream of said first end portion in a movement direction of the recording material relative to said probe, and a tip end of said second end portion abuts against the recording material at said bent portion in a direction counter to the movement direction of the recording material relative to said probe.

2. A surface discriminating device according to claim 1, wherein an area from said bent portion to said first end portion is defined as L1, a length thereof is defined as L1', an area from said bent portion to said tip end of said second probe is defined as L2, and a length thereof is defined as L2', and wherein a relation between the lengths of the respective areas is L1'>L2' and L2'≧0, and an angle β1 formed by the area L2 and a scanning upstream side plane, upstream of a tip end abutting point of the area L2, of a scanning plane satisfies the following relationship:

$$\angle\beta 1 < 90°.$$

3. A surface discriminating device according to claim 1, further comprising spacing and contacting means for spacing the tip end of said second end portion apart from a surface of the recording material at an initial stage of scanning, and making the tip end of said second end portion abut against the recording material after a leading edge portion of the recording material has passed a position of the tip end of said second end portion.

4. A surface discriminating device according to claim 1, wherein said probe is made of a single metal plate, and an area, which is contactable with a surface of the recording material, of a tip end of said second end portion is subjected to burr trimming, and at least a corner of the area as viewed from a tip end plane direction is subjected to rounding of a radius of curvature of 0.3 mm or greater, and a corner of the area as viewed from a cross section direction is subjected to rounding of a radius of curvature of 0.1 mm or greater and 0.3 mm or less.

5. A surface discriminating device according to claim 4, wherein at least the area, which is contactable with the surface of the recording material, of the tip end of said second end portion is subjected to a polishing process.

6. A surface discriminating device according to claim 1, wherein the tip end of said second end portion is subjected to a localized bending, and a portion thereof subjected to said bending contacts with the recording material.

7. A surface discriminating device according to claim 1, wherein the tip end of said second end portion is subjected to an embossing process for protruding it, and a portion subjected to said embossing process contacts with the recording material.

8. A surface discriminating device according to claim 1, wherein the tip end of said second end portion is covered with a covering material.

9. A surface discriminating device according to claim 1, wherein a member constituting said second end portion is different from a member constituting said first end portion.

10. A surface discriminating device according to claim 1, wherein the output from said piezoelectric element is detected as the frictional resistance difference of the surface of the recording material.

11. A surface discriminating device according to claim 1, further comprising storing means for storing therein in advance a vibration characteristic difference detected for each recording material which is an object of discrimination for each recording material, wherein a result of detection when a surface of an unknown recording material has been scanned is compared with the vibration characteristic difference for each recording material stored in said storing means, whereby the unknown recording material is classified into any one of recording materials which are the objects of discrimination and the kind of a surface quality of the recording material is discriminated.

12. A surface discriminating device according to claim 1, further comprising recording material holding-down means provided on opposite side portions of said probe with respect to a scanning direction, said recording material holding-down means for holding down, when the recording material is scanned with the recording material being placed on a smooth flat plate, the recording material on said smooth flat plate, so that the recording material is scanned with at least a portion, scanned by said probe, of the recording material being in close contact with said smooth flat plate.

13. A surface discriminating device according to claim 12, wherein said recording material holding-down means comprises one or more pairs of rotatable runner members brought into pressure contact with said smooth flat plate.

14. A surface discriminating device according to claim 1, further comprising AC voltage applying means for applying an AC voltage to said piezoelectric element, wherein said AC voltage applying means is made to act during a non-discriminating period, whereby any stain adhering to a surface of said probe is removed by use of vibration created in said piezoelectric element by application of the AC voltage.

15. A surface discriminating device according to claim 1, wherein in scanning, said probe is stationary and the recording material is moved.

16. A surface discriminating device for discriminating a surface of a recording material comprising:

a probe having a fixed first end portion and a second end portion contactable with the recording material, said probe being brought into contact with the recording material to scan the recording material by relative movement between the recording material and said probe; and a piezoelectric element provided between said first end portion and said second end portion of said probe, wherein the surface of the recording material is discriminated on the basis of output from said piezoelectric element in scanning of the recording material by said probe, wherein said probe has a bent portion on a side of said second end portion, and wherein said first end portion is fixed to a rotary shaft.

17. A surface discriminating device according to claim 16, wherein said second end portion is provided downstream of said first end portion in a movement direction of the recording material relative to said probe, and a tip end of said second end portion abuts against the recording material at said bent portion in a direction counter to the movement direction of the recording material relative to said probe.

18. A surface discriminating device according to claim 17, wherein an area from said bent portion to said first end portion is defined as L1, a length thereof is defined as L1', an area from said bent portion to said tip end of said probe is defined as L2, and a length thereof is defined as L2', and wherein a relation between the lengths of the respective areas is L1'>L2' and L2'≧0, and an angle β1 formed by the area L2 and a scanning upstream side plane, upstream of a tip end abutting point of the area L2, of a scanning plane satisfies the following relationship:

$$\angle\beta 1 < 90°.$$

19. A surface discriminating device according to claim 17, further comprising spacing and contacting means for spacing the tip end of said second end portion apart from a surface of the recording material at an initial stage of scanning, and making the tip end of said second end portion abut against the recording material after a leading edge portion of the recording material has passed a position of the tip end of said second end portion.

20. A surface discriminating device according to claim 16, wherein the output from said piezoelectric element is detected as the frictional resistance difference of the surface of the recording material.

21. A surface discriminating device according to claim 16, further comprising storing means for storing therein in advance a vibration characteristic difference detected for each recording material which is an object of discrimination for each recording material, wherein a result of detection when a surface of an unknown recording material has been scanned is compared with the vibration characteristic difference for each recording material stored in said storing means, whereby the unknown recording material is classified into any one of recording materials which are the objects of discrimination and the kind of a surface quality of the recording material is discriminated.

22. A surface discriminating device according to claim 16, wherein in scanning, said probe is stationary and the recording material is moved.

23. A surface discriminating device for discriminating a surface of a recording material comprising:

a probe having a fixed first end portion and a second end portion contactable with the recording material, said probe being brought into contact with the recording material to scan the recording material by relative movement between the recording material and said probe; and a piezoelectric element provided between said first end portion and said second end portion of said probe, wherein the surface of the recording material is discriminated on the basis of output from said piezoelectric element in scanning of the recording material by said probe, wherein said probe has a bent portion on a side of said second end portion, and wherein a tip end of said second end portion is a vibrating portion vibratable for repeating deformation and restitution in a scanning direction.

24. A surface discriminating device according to claim 23, wherein a portion between said first end portion and said second end portion of said probe is a structural portion which mechanically transmits a deformation amount difference, a vibration intensity difference and a shock intensity difference in the scanning direction created in said vibrating portion in accordance with a frictional resistance difference of a surface of the recording material in scanning to thereby induce a deformation amount difference, a vibration intensity difference and a shock intensity difference in an electromotive force generating direction of said piezoelectric element.

25. A surface discriminating device according to claim 23, wherein said second end portion is provided downstream of said first end portion in a movement direction of the recording material relative to said probe, and a tip end of said second end portion abuts against the recording material at said bent portion in a direction counter to the movement direction of the recording material relative to said probe.

26. A surface discriminating device according to claim 25, wherein an area from said bent portion to said first end portion is defined as L1, a length thereof is defined as L1', an area from said bent portion to said tip end of said probe is defined as L2, and a length thereof is defined as L2', and wherein a relation between the lengths of the respective areas is L1'>L2' and L2'≧0, and an angle β1 formed by the area L2 and a scanning upstream side plane, upstream of a tip end abutting point of the area L2, of a scanning plane satisfies the following relationship:

$$\angle\beta 1 < 90°.$$

27. A surface discriminating device according to claim 25, further comprising spacing and contacting means for spacing the tip end of said second end portion apart from a surface of the recording material at an initial stage of scanning, and making the tip end of said second end portion abut against the recording material after a leading edge portion of the recording material has passed a position of the tip end of said second end portion.

28. A surface discriminating device according to claim 23, wherein the output from said piezoelectric element is detected as the frictional resistance difference of the surface of the recording material.

29. A surface discriminating device according to claim 23, further comprising storing means for storing therein in advance a vibration characteristic difference detected for each recording material which is an object of discrimination for each recording material, wherein a result of detection when a surface of an unknown recording material has been scanned is compared with the vibration characteristic difference for each recording material stored in said storing means, whereby the unknown recording material is classified into any one of recording materials which are the objects of discrimination and the kind of a surface quality of the recording material is discriminated.

30. A surface discriminating device according to claim 23, wherein in scanning, said probe is stationary and the recording material is moved.

* * * * *

UNITED STATES PATENT AND TRADEMARK OFFICE

CERTIFICATE OF CORRECTION

PATENT NO. : 6,731,886 B2
DATED : May 4, 2004
INVENTOR(S) : Takeda

It is certified that error appears in the above-identified patent and that said Letters Patent is hereby corrected as shown below:

Column 1,
Line 58, “with” should read -- which --.

Column 8,
Line 23, “less is” should read -- less --.

Column 15,
Line 67, “consumed extra” should read -- consumed --.

Column 16,
Line 32, “energy” should read -- extra energy --, and “consumed extra” should read -- consumed --.

Column 18,
Line 35, “leapt” should read -- pushed --.

Column 19,
Line 20, “evils” should read -- drawbacks --.

Column 20,
Line 11, “eats” should read -- bites --.
Line 61, “eat” should read -- bite --.

Column 21,
Line 67, “injure” should read -- damage --.

Signed and Sealed this

Fourth Day of January, 2005

JON W. DUDAS
*Director of the United States Patent and Trademark Office*